US007555238B2

(12) United States Patent
Igarashi

(10) Patent No.: US 7,555,238 B2
(45) **Date of Patent: *Jun. 30, 2009**

(54) IMAGE-FORMING DEVICE AND ANGULARLY SHIFTED BELT UNIT

(75) Inventor: Hiroshi Igarashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 385 days.

This patent is subject to a terminal disclaimer.

(21) Appl. No.: 11/235,069

(22) Filed: Sep. 27, 2005

(65) Prior Publication Data

US 2006/0079358 A1 Apr. 13, 2006

(30) Foreign Application Priority Data

Sep. 29, 2004 (JP) ..... 2004-285073
Oct. 29, 2004 (JP) ..... 2004-317218
Mar. 24, 2005 (JP) ..... 2005-086332

(51) Int. Cl.
*G03G 15/08* (2006.01)

(52) U.S. Cl. ..... 399/121; 399/124; 399/303

(58) Field of Classification Search ..... 399/121, 399/124, 303

See application file for complete search history.

(56) References Cited

U.S. PATENT DOCUMENTS 5,136,339 A 8/1992 Morita et al.
5,151,810 A 9/1992 Blanding et al.
5,216,475 A 6/1993 Ohno
5,237,348 A 8/1993 Blanding et al.
5,313,257 A 5/1994 Kashima et al.
5,461,461 A 10/1995 Harasawa et al.
5,557,384 A 9/1996 Takano et al.
5,559,590 A 9/1996 Arai et al.
5,640,660 A 6/1997 Takano et al.
5,659,843 A 8/1997 Takano et al.
5,666,622 A 9/1997 Harasawa et al.
5,867,760 A * 2/1999 Mitsuoka et al. ..... 399/313
5,897,241 A 4/1999 Takano et al.
5,978,617 A 11/1999 Takano et al.
6,085,051 A 7/2000 Miyasaka et al.
6,501,925 B2 12/2002 Yamamoto et al.

(Continued)

FOREIGN PATENT DOCUMENTS

JP A 53-012335 2/1978

(Continued)

*Primary Examiner*—David M Gray
*Assistant Examiner*—Ruth N Labombard
(74) *Attorney, Agent, or Firm*—Oliff & Berridge, PLC

(57) ABSTRACT

In an image-forming device, a belt unit is detachably mounted in the housing. The belt unit moves to an installation position along a linear insertion/removal path in an insertion direction when the belt unit is mounted in the housing. The belt unit includes: a plurality of rollers; and an endless belt that is supported by the plurality of rollers and is capable of moving circumferentially around the plurality of rollers. A surface of the endless belt contacts a surface of the at least one photosensitive member when the belt unit is located in the installation position. The endless belt moves in a belt-moving direction that is angularly shifted from the removal direction to allow the surface of the endless belt to separate from each photosensitive member when the belt unit starts moving in the removal direction from the installation position.

23 Claims, 8 Drawing Sheets

U.S. PATENT DOCUMENTS

| | | | | |
|---|---|---|---|---|
| 6,600,504 | B2 | 7/2003 | Okugawa et al. | |
| 6,708,011 | B2 | 3/2004 | Nomura et al. | |
| 6,922,534 | B2 | 7/2005 | Goto et al. | |
| 6,973,283 | B2 | 12/2005 | Sato et al. | |
| 7,184,070 | B2 | 2/2007 | Kaiho | |
| 7,242,888 | B2 | 7/2007 | Ishii | |
| 7,257,351 | B2 * | 8/2007 | Tachiki et al. | 399/121 |
| 2003/0059230 | A1 | 3/2003 | Yokoi et al. | |
| 2003/0147678 | A1 | 8/2003 | Ozawa et al. | |
| 2006/0002735 | A1 | 1/2006 | Tamaru et al. | |

FOREIGN PATENT DOCUMENTS

| | | |
|---|---|---|
| JP | U-60-170340 | 11/1985 |
| JP | A 61-116366 | 6/1986 |
| JP | A 02-163762 | 6/1990 |
| JP | A-04-329557 | 11/1992 |
| JP | A 05-072837 | 3/1993 |
| JP | A-05-162881 | 6/1993 |
| JP | A 05-229686 | 9/1993 |
| JP | A-06-003919 | 1/1994 |
| JP | A 06-183056 | 7/1994 |
| JP | A-07-234622 | 9/1995 |
| JP | A-07-304540 | 11/1995 |
| JP | A 07-306603 | 11/1995 |
| JP | A-07-306603 | 11/1995 |
| JP | A 08-069241 | 3/1996 |
| JP | A-08-087151 | 4/1996 |
| JP | A-08-190245 | 7/1996 |
| JP | A 09-197736 | 7/1997 |
| JP | A 09-204083 | 8/1997 |
| JP | A-09-235041 | 9/1997 |
| JP | A-09-325544 | 12/1997 |
| JP | A 10-186775 | 7/1998 |
| JP | A 10-194530 | 7/1998 |
| JP | A 10-198118 | 7/1998 |
| JP | A 11-95520 | 4/1999 |
| JP | A 11-143335 | 5/1999 |
| JP | A 11-327246 | 11/1999 |
| JP | A-11-338216 | 12/1999 |
| JP | A 2000-172041 | 6/2000 |
| JP | A-2000-267380 | 9/2000 |
| JP | A 2000-275987 | 10/2000 |
| JP | A-2000-280570 | 10/2000 |
| JP | A-2001-133718 | 5/2001 |
| JP | A-2001-222207 | 8/2001 |
| JP | A 2001-228664 | 8/2001 |
| JP | A-2001-228664 | 8/2001 |
| JP | A-2001-228722 | 8/2001 |
| JP | A 2001-228722 | 8/2001 |
| JP | A-2001-249601 | 9/2001 |
| JP | A 2001-331003 | 11/2001 |
| JP | A-2001-341890 | 12/2001 |
| JP | A-2001-350307 | 12/2001 |
| JP | A-2002-108172 | 4/2002 |
| JP | A 2002-139926 | 5/2002 |
| JP | A-2002-139926 | 5/2002 |
| JP | A-2002-174940 | 6/2002 |
| JP | A 2002-174940 | 6/2002 |
| JP | A 2002-318494 | 10/2002 |
| JP | A-2002-318494 | 10/2002 |
| JP | A-2002-323833 | 11/2002 |
| JP | B2 3408221 | 3/2003 |
| JP | A 2003-107838 | 4/2003 |
| JP | A 2003-131472 | 5/2003 |
| JP | A-2003-173066 | 6/2003 |
| JP | B2 3439732 | 6/2003 |
| JP | A 2003-195726 | 7/2003 |
| JP | A 2003-248380 | 9/2003 |
| JP | A-2003-248380 | 9/2003 |
| JP | A 2003-248381 | 9/2003 |
| JP | A-2003-248381 | 9/2003 |
| JP | A-2003-248389 | 9/2003 |
| JP | A 2003-248389 | 9/2003 |
| JP | A 2003-280489 | 10/2003 |
| JP | A 2004-109466 | 4/2004 |
| JP | A-2004-144918 | 5/2004 |
| JP | A-2004-217331 | 8/2004 |
| JP | A 2004-30194 | 10/2004 |

* cited by examiner

IMAGE-FORMING DEVICE AND ANGULARLY SHIFTED BELT UNIT

BACKGROUND OF THE INVENTION

1. Field of the Invention

The present invention relates to an image-forming device such as a laser printer, and a belt unit installed therein.

2. Description of Related Art

In a color laser printer of a tandem type, process cartridges corresponding to the colors of yellow, magenta, cyan, and black are disposed in parallel in the horizontal direction.

In the color laser printer of the tandem type, an endless belt is supported in a circumferentially movable manner on a plurality of rollers, and is disposed in contact from below with photosensitive drums for each color. Paper is conveyed by the belt so as to pass between the belt and each photosensitive drum in sequence, and a toner image that is supported on each photosensitive drum is transferred in an overlapping manner onto the paper during the conveying. This ensures that a multicolor image is formed on the paper at substantially the same speed as that of forming a monochromatic image.

Japanese Patent No. 3439732 has proposed an image forming device with a belt unit. An endless belt is provided in the belt unit, and is in contact with photosensitive drums from below when the belt unit is mounted in the image forming device. The Japanese Patent has proposed a mechanism of removing the belt unit from the image forming device by first moving the belt unit downward to separate the endless belt from photosensitive drums, and then by moving the belt unit in the horizontal direction parallel to the direction in which the endless belt conveys paper on its upper surface.

SUMMARY OF THE INVENTION

However, the configuration disclosed in the Japanese Patent for guiding the motion of the belt unit downwardly and then horizontally is complicated and leads to increases in production costs and in the size of the entire image-forming device.

In view of the above-described drawbacks, it is an object of the present invention to provide an image-forming device, from which an endless belt can be easily removed, which can be produced with low cost, and which has a small size. It is another object of the present invention to provide the belt unit.

In order to attain the above and other objects, the present invention provides an image-forming device, including: a housing; at least one photosensitive member; and a belt unit. The housing defines a linear insertion/removal path and defines an installation position on the linear insertion/removal path. An insertion direction and a removal direction are defined along the linear insertion/removal path as opposed to each other. The at least one photosensitive member is mounted in the housing and that forms a developer image thereon. The belt unit is detachably mounted in the housing. The belt unit is movable along the linear insertion/removal path. The belt unit moves to the installation position along the linear insertion/removal path in the insertion direction when the belt unit is mounted in the housing. The belt unit moves from the installation position along the linear insertion/removal path in the removal direction to be detached from the housing. The belt unit includes: a plurality of rollers; and an endless belt that is supported by the plurality of rollers. The endless belt is capable of moving circumferentially around the plurality of rollers. A surface of the endless belt contacts a surface of the at least one photosensitive member when the belt unit is located in the installation position. The endless belt moves in a belt-moving direction at a contact position where the endless belt contacts each photosensitive member. The belt-moving direction is angularly shifted from the removal direction to allow the surface of the endless belt to separate from each photosensitive member when the belt unit starts moving in the removal direction from the installation position.

According to another aspect, the present invention provides a belt unit that can be detachably mounted in an image forming device. The belt unit includes: a belt unit frame; a plurality of rollers; and an endless belt. The belt unit frame can be moved along a linear insertion/removal path defined for an image forming device including at least one photosensitive member forming a developer image thereon. The belt unit frame can be installed in the image forming device at an installation position defined on the insertion/removal path. The belt unit frame is capable of being moved toward the installation position in the image forming device along the insertion/removal path in an insertion direction. The belt unit frame is capable of being moved from the installation position along the insertion/removal path in a removal direction that is opposite to the insertion direction. The plurality of rollers are supported by the belt unit frame. The endless belt is supported by the rollers. The endless belt is capable of moving circumferentially around the plurality of rollers. A surface of the endless belt contacts the at least one photosensitive member when the belt unit frame is located in the installation position in the image forming device. The endless belt moves in a belt-moving direction at its contact position where the endless belt contacts each photosensitive drum. The belt-moving direction is angularly shifted from the removal direction to allow the surface of the endless belt to separate from each photosensitive member when the belt unit starts moving in the removal direction from the installation position.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENT

Figure 1:
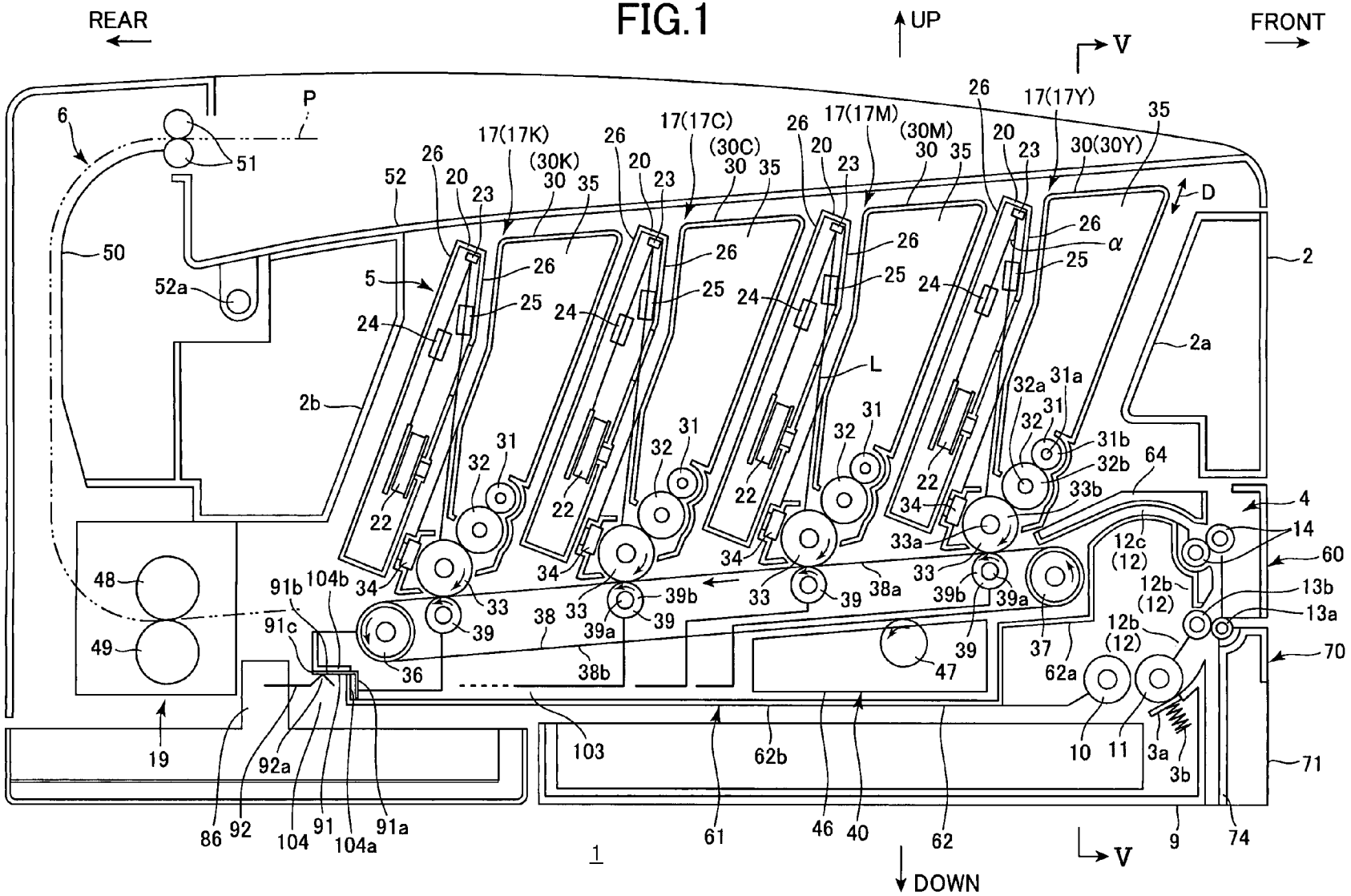
FIG. 1 is a sectional side view of a color laser printer according to an embodiment of the present invention.

An image-forming device and a belt unit according to a preferred embodiment of the present invention will be described while referring to the accompanying drawings wherein like parts and components are designated by the same reference numerals to avoid duplicating description.

A color laser printer 1 according to the preferred embodiment will be described with reference to FIG. 1 -FIG. 8.

In the following description, the expressions "front", "rear", "upper", "lower", "right", and "left" are used to define the various parts when the color laser printer 1 is disposed in an orientation in which it is intended to be used.

As shown in FIG. 1, the color laser printer 1 is of a horizontal-tandem type, in which a plurality of image-forming portions 17 are arranged in line along a substantially horizontal direction. The laser printer 1 has a main casing 2, in which an image forming section 5, a sheet conveying section 4, a fixing section 19, and a sheet discharging section 6 are provided.

The image forming section 5 is for forming toner images. The sheet conveying section 4 is for conveying a sheet of paper P as a recording medium and is for transferring the toner images onto the sheet of paper as a multicolor image. The fixing section 19 is for fixing the multicolor image onto the sheet of paper P. The sheet discharging section 6 is for discharging the sheet of paper P with the multicolor image formed thereon.

Figure 5:
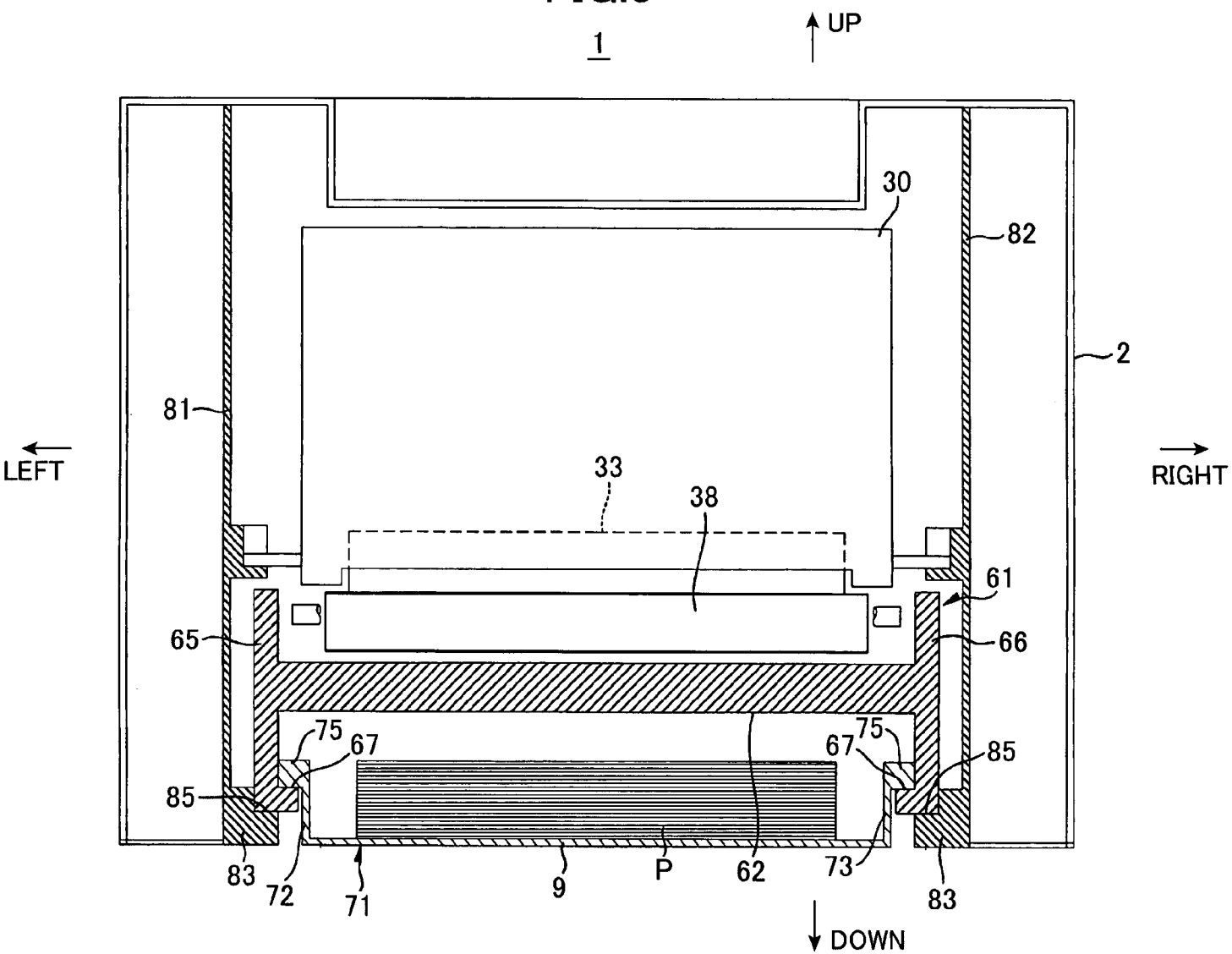
FIG. 5 is a cross-section of the color laser printer of FIG. 1 taken along a line V-V in FIG. 1.

The main casing 2 acts as a housing of the color laser printer 1. The main casing 2 is of a box shape with its upper opening being covered by a sheet-discharge tray 52. Thus, the sheet-discharge tray 52 serves as a top cover. The sheet discharge tray 52 is of an inclined wall shape that slopes downward from front to rear. The sheet-discharge tray 52 is supported rotatably via a hinge 52*a* to the main casing 2, and is openable and closable with respect to the main casing 2. The main casing 2 has a front inner wall 2*a* and a rear inner wall 2*b*, both of which are oriented to extend in a direction slanted forwardly upwardly. The main casing 2 also has a left main casing side plate 81 and a right main casing side plate 82 as shown in FIG. 5.

The image-forming section 5 is located at an upper part within the main casing 2 immediately below the sheet-discharge tray 52. The image-forming section 5 includes the four image forming portions 17 (17Y, 17M, 17C, and 17K). The image forming portion 17Y is for forming a yellow toner image, the image forming portion 17M is for forming a magenta toner image, the image forming portion 17C is for forming a cyan toner image, and the image forming portion 17K is for forming a black toner image. The image-forming portions 17Y, 17M, 17C, and 17K are arranged in this order from front to rear with a certain amount of distance therebetween. The image-forming portions 17Y, 17M, 17C, and 17K are arranged in a horizontally overlapping condition with one another. Each image-forming portion 17 is positioned slightly higher than its neighboring image-forming portion 17 in the rear side thereof.

Each image-forming portion 17 has a scanner unit 20 and a process cartridge 30. The image-forming portions 17 are arranged so that the scanner units 20 and the process cartridges 30 are arranged alternately in the rear-to-front direction. The process cartridges 30 in the respective image-forming portions 17Y, 17M, 17C, and 17K will be referred to as process cartridges 30Y, 30M, 30C, and 30K, respectively. Each process cartridge 30 is detachable from the main casing 2.

The sheet conveying section 4 is located at a lower part within the main casing 2 below the image-forming section 5. The sheet conveying section 4 includes: a sheet supply cassette 70; a belt unit 60; and an electrode holder 86.

Figure 2:
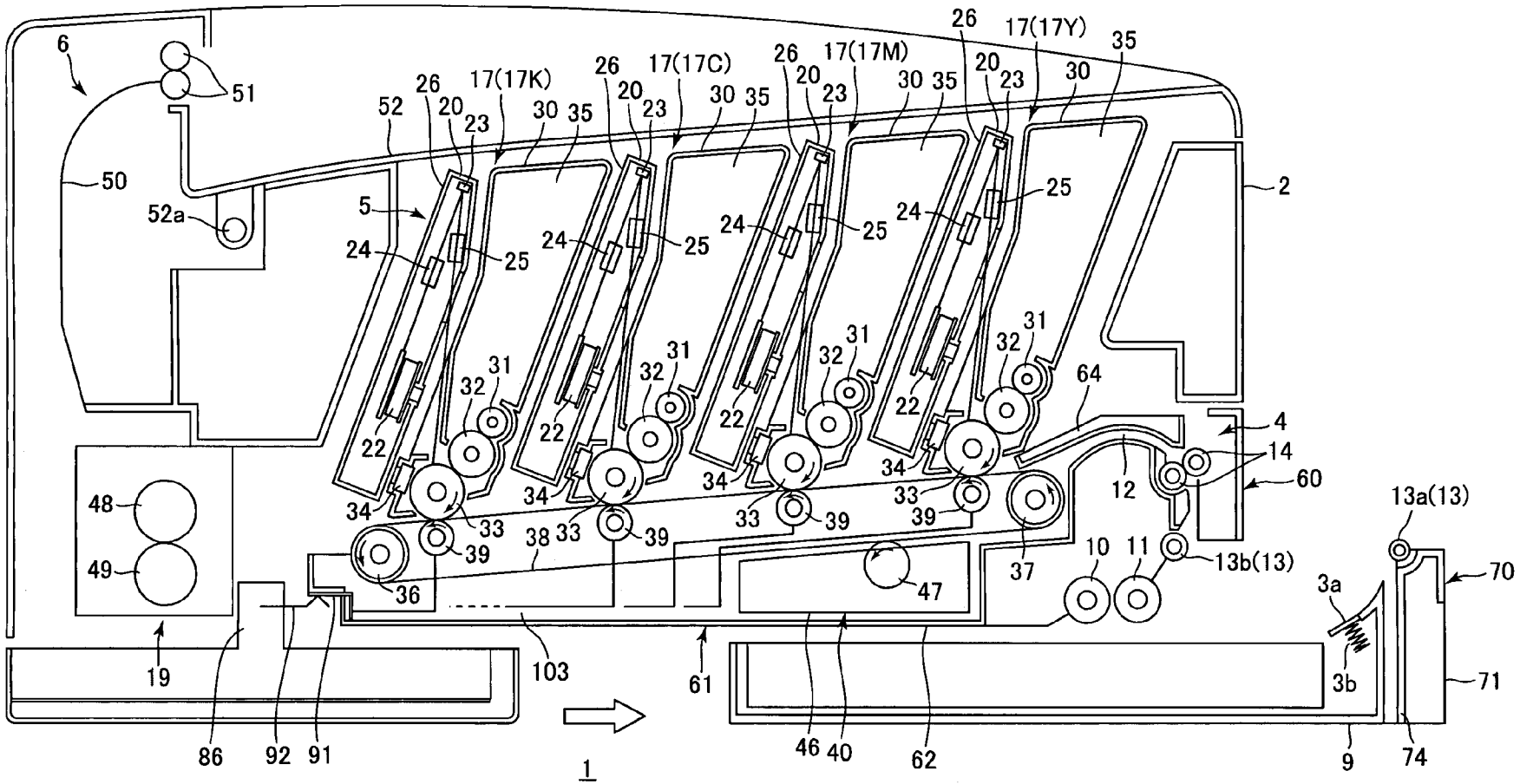
FIG. 2 is a sectional side view showing a state in which a sheet supply cassette is withdrawn from the color laser printer of FIG. 1.

The sheet supply cassette 70 is detachably mounted in the main casing 2 at its lowest portion. FIG. 1 shows the state where the sheet supply cassette 70 is disposed in its installation position in the main casing 2. The sheet supply cassette 70 can be withdrawn from the front side of the main casing 2 in the forward direction as shown in FIG. 2.

Figure 3:
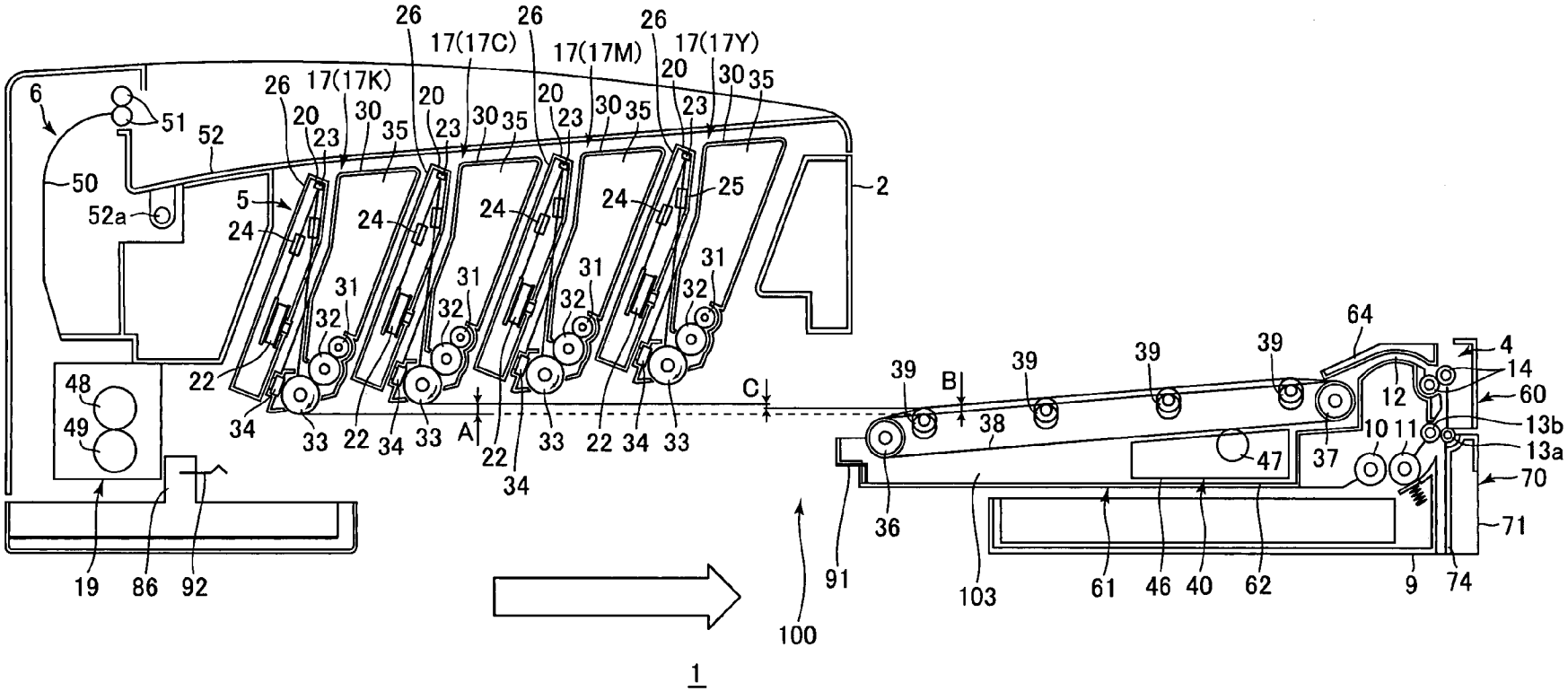
FIG. 3 is a sectional side view showing a state in which the paper supply cassette and a belt unit are withdrawn as an integral unit from the color laser printer of FIG. 1.

The belt unit 60 is also detachably mounted in the main casing 2 at a location above the sheet supply cassette 70 and below the image forming portions 17. FIG. 1 shows the state where the belt unit 60 is disposed in its installation position in the main casing 2. The belt unit 60 and the sheet supply cassette 70 can be withdrawn in an integral unit in the forward direction from the front side of the main casing 2 as shown in FIG. 3.

The electrode holder 86 is mounted in the main casing 2 in the rear side of the sheet supply cassette 70 and the belt unit 60. The electrode holder 86 has a plurality of electrodes 92, which will be described later with reference to FIG. 6.

The fixing section 19 is located in a rear part of the main casing 2. The fixing section 19 includes a heating roller 48 and a pressure roller 49.

The sheet discharging section 6 is provided in the rear side of the main casing 2. The sheet discharging section 6 includes: a sheet discharge side U-shaped path 50; a pair of sheet discharge rollers 51; and the discharge tray 52.

Next will be described in greater detail the configuration of the color laser printer 1.

<Image Forming Section 5>

In the image forming section 5, the scanner units 20 are mounted in the main casing 2 at positions between the front inner wall 2*a* and the rear inner wall 2*b* and below the sheet-discharge tray 52. Each scanner unit 20 includes a scanner housing 26. A laser diode (not shown in the figure), a polygon mirror 22, an fθ lens 24, a fold-back mirror 23, and a cylindrical lens 25 are mounted in the scanner housing 26.

The scanner housing 26 is of a box shape, which is substantially in an elongated rectangular shape seen from the side thereof. The scanner housing 26 is oriented with its longitudinal direction being substantially parallel to the front inner wall 2*a* and the rear inner wall 2*b*. Thus, each scanner unit 20 is oriented with its longitudinal direction extending in a direction slanted forwardly upwardly. In other words, the scanner units 20 are disposed at an angle with the upper ends thereof inclined forward.

The process cartridges 30 are inclined substantially at the same angle with the scanner units 20 with respect to the front-to-rear (horizontal) direction. That is, the process cartridges 30 are disposed also at an angle with the upper end thereof inclined forward. Each process cartridge 30 can be removed from the main casing 2 by rotating the discharge tray 52 upward to open the device. Each process cartridge 30 can be inserted in or removed from the main casing 2 along a direction D that is parallel with the front inner wall 2*a* and the rear inner wall 2*b* and therefore that is inclined in both the horizontal direction (front-to-rear direction) and the vertical direction. In other words, each process cartridge 30 is inserted in or removed from the main casing 2 in a direction that is inclined forwardly upwardly.

As shown in FIG. 3, the installation position of each process cartridge 30 is offset by a predetermined amount "A" higher than that of its rear-side neighboring process cartridge 30. More specifically, each process cartridge 30 has a photosensitive drum 33 at its bottom as will be described later. The process cartridges 30 are arranged, with a line connecting the lower sides of the photosensitive drums 33 extending forwardly upwardly at an angle of greater than zero (0) degree with respect to the rear-to-front direction (horizontal direction).

Each process cartridge 30 includes: a supply roller 31, a developing roller 32, the photosensitive drum 33, and a Scorotron charger 34. The photosensitive drum 33 is located in the lowermost position in the process cartridge 30. The lower side of the photosensitive drum 33 is exposed outside of the process cartridge 30. A toner box 35 is defined in an upper part of the interior of the process cartridge 30. Yellow color toner, magenta color toner, cyan color toner, and black toner are stored in the toner boxes 35 of the process cartridges 30Y, 30M, 30C, and 30K, respectively.

The photosensitive drum 33 is rotatably supported in each process cartridge 30 at a lower end thereof. The photosensitive drum 33 includes: a main drum body 33*b* that is cylindrical in shape; and a drum shaft 33*a* extending along the axial center of the main drum body 33*b* in its axial direction. The process cartridge 30 is mounted in the main casing 2 with the drum shaft (rotational shaft) 33*a* extending in the widthwise direction of the main casing 2. The main drum body 33*b* has, on its outer surface, a photosensitive layer formed of polycarbonate or the like that has a positively charging nature. The drum shaft 33*a* is fixedly secured to both of the widthwise side plates (right-side and left-side plates) configuring the process cartridge 30. The drum shaft 33*a* is unable to rotate relative to the side plates. The main drum body 33*b* is rotatably supported on the drum shaft 33*a*. In this way, the photosensitive drum 33 is rotatably supported in the process cartridge 30.

During an image formation process, the photosensitive drum 33 is driven to rotate in the clockwise direction in the figure.

The Scorotron charger 34 is of a positively charging type, and has a wire and a grid for generating a corona discharge. The Scorotron charger 34 is disposed rearward of the photosensitive drum 33. The Scorotron charger 34 is in opposition to but is separate a distance from the photosensitive drum 33 so as not to contact the same.

The developing roller 32 is disposed above and in opposition to the photosensitive drum 33. The developing roller 32 is pressed against the photosensitive drum 33. The developing roller 32 has a metal roller shaft 32*a* covered with a roller 32*b* made from an elastic material, specifically a conductive rubber material. More specifically, the roller part 32*b* of the developing roller 32 has a two-layer configuration including: an elastic roller part which is made from a conductive urethane rubber, silicone rubber, or EPDM rubber and which contains carbon powder; and a coating layer, which is made mainly of urethane rubber, urethane resin, or polyimide resin. The roller shaft 32*a* is rotatably supported by the pair of widthwise side plates of the process cartridge 30.

The supply roller 31 is disposed above and in opposition to the developing roller 32. The supply roller 31 is pressed against the developing roller 32. The supply roller 31 is configured of a metal roller shaft 31*a* that is covered by a roller 31*b* formed of a conductive foam material. The roller shaft 31*a* is rotatably supported on both of the widthwise side walls of the process cartridge 30.

The toner tank 35 is defined in the process cartridge 30 at an upper portion of the supply roller 31.

The toner stored in the toner tank 35 is a non-magnetic single component polymer toner with a positive charging nature. In this example, the toner is a polymer toner with substantially spherical particles. The polymer toner includes binding resins as its main component. Each binding resin is made by copolymerizing a polymerizing monomer using a well-known polymerization method such as suspension polymerization. Examples of the polymerizing monomer include styrene monomers, such as styrene, and acrylic monomers, such as acrylic acid, alkyl (C1-C4) acrylate, and alkyl (C1-C4) meta-acrylate.

Main toner particles are formed by adding coloring agents, charge regulators, and wax to the binding resins. In the present embodiment, the coloring agents are yellow, magenta, cyan, and black coloring agents. Examples of charge regulators that can be used in this example include a charge regulating resin obtained by copolymerizing an ionic monomer with a copolymerizing monomer. In this case, the ionic monomer can be an ammonium salt or other monomer with an ionic functional group. The copolymerizing monomer is capable of copolymerizing with the ionic monomer and can be a styrene monomer, an acrylic monomer, or other monomer.

An external additive, such as silica, is added to the main toner particles for the purpose of increasing fluidity of the toners. Powders of various inorganic materials can be used as an external additive. For example, powders of a metallic oxide, a carbide, or a metallic salt can be used as an external additive. Examples of a metallic oxide powder that can be used as an external additive include silica, aluminum oxide (alumina), titanium oxide, strontium titanate, cerium oxide, and magnesium oxide.

With the above-described configuration, each image forming portion 17 executes an image forming process as described below.

The laser diode (not shown in the figure) emits a laser beam L according to image data. The polygon mirror 22 deflects the laser beam L along a scanning direction that is orthogonal to the sheet of FIG. 1. The fθ lens 24 transmits the laser beam L from the polygon mirror 22. The fold-back mirror 23 receives the laser beam L deflected by the polygon mirror 22 and reflects the laser beam L towards the photosensitive drum 33 of the corresponding process cartridge 30. The cylindrical lens 25 transmits the laser beam L reflected from the fold-back mirror 23. The laser beam L exits the housing 26 to travel to the photosensitive drum 33 of the corresponding process cartridge 30.

Toner stored in the toner tank 35 is supplied to the supply roller 31. As the supply roller 31 rotates, the toner is supplied to the developing roller 32. While the toner is being supplied from the supply roller 31 to the developing roller 32, the toner is charged to a positive polarity due to friction between the supply roller 31 and the developing roller 32, which is applied with a developing bias.

The scorotron charger 34 is applied with a charging bias to generate a corona discharge, thereby electrically charging the surface of the photosensitive drum 33 uniformly to a positive polarity. As the photosensitive drum 33 rotates, the surface of the photosensitive drum 33 that has been charged to a positive polarity is exposed to a high-speed scan of a laser beam from the scanner unit 20. As a result, an electrostatic latent image corresponding an image desired to be formed on a paper is formed on the surface of the photosensitive drum 33.

As the photosensitive drum 33 further rotates, the positively-charged toner that is born on the surface of the developing roller 32 is brought into contact with the photosensitive drum 33. At this time, the toner on the developing roller 32 is supplied to lower-potential areas of the electrostatic latent image on the photosensitive drum 33 that have been exposed to the laser beam. As a result, the toner is selectively borne on the photosensitive drum 33 so that the electrostatic latent image is developed into a visible toner image.

<Sheet Conveying Section 4>

The sheet supply cassette 70 includes: a sheet supply cassette frame 71; a paper tray 9; a separation pad 3*a*; a spring 3*b*; and a front conveyer roller 13*a*.

As shown in FIGS. 1 and 5, the sheet supply cassette frame 71 has: a left-side plate 72; a right-side plate 73; and a front plate 74. The left-side plate 72 and the right-side plate 73 are disposed facing each other in the widthwise direction at a certain distance apart. The front plate 74 is suspended between the front end portions of the left-side plate 72 and the right-side plate 73. The sheet supply cassette frame 71 holds the paper tray 9 between the left-side plate 72 and the right-side plate 73 at a location rear to the front plate 74. The sheet supply cassette frame 71 also holds the separation pad 3*a* and the spring 3*b* between the left-side plate 72 and the right-side plate 73. The front conveyer roller 13*a* is suspended between the left-side plate 72 and the right-side plate 73 in a rotatabe manner.

The sheet supply cassette 70 can be pulled out from the storage position shown in FIG. 1 toward the pulled-out position shown in FIG. 2, in which state some recording paper P can be replenished as appropriate in the paper tray 9. In this way, the sheet supply cassette 70 can be inserted into and removed from the main casing 2 horizontally through the front side of the main casing 2.

A space defined below the image forming portions 17 and above the sheet supply cassette 70 has a tapered shape in which the height in the vertical direction narrows towards the rear as seen from the side. The belt unit 60 also has a tapered shape in which the height in the vertical direction narrows towards the rear as seen from the side. Accordingly, the belt unit 60 can be approximately disposed in the space between the image forming portions 17 and the sheet supply cassette 70.

The belt unit 60 includes a belt unit frame 61. Various components are supported on the belt unit frame 61. The components include: a drive roller 36, a follower roller 37, the conveyer belt 38, four transfer rollers 39, a belt cleaning unit 40, a pickup roller 10, a paper supply roller 11, a paper supply side U-shaped path 12, a rear conveyor roller 13*b*, a pair of registration rollers 14, and a plurality of terminals 91.

Figure 4:
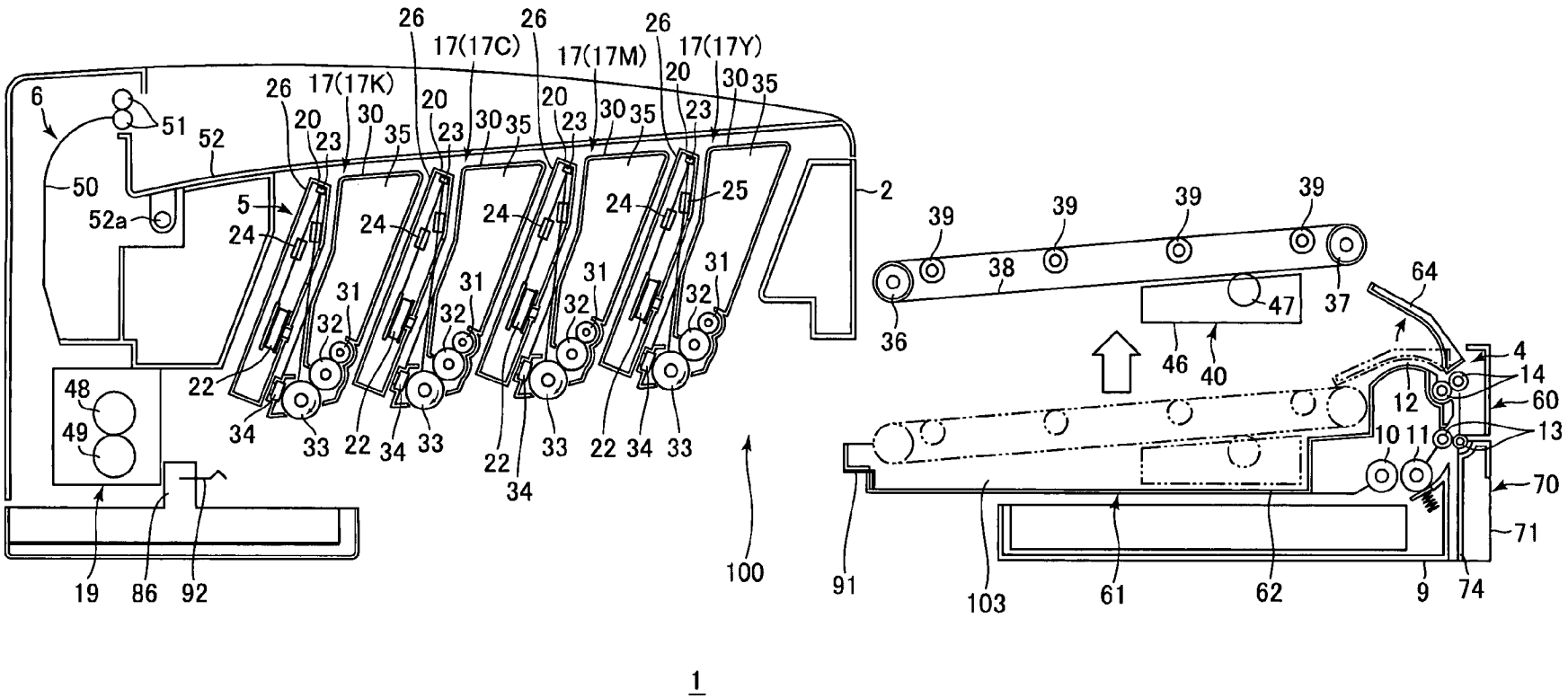
FIG. 4 is a sectional side view of a state in which a conveyor belt and a belt cleaning device are removed from the belt unit of FIG. 3.

As shown in FIGS. 1 and 5, the belt unit frame 61 includes: a left-side plate 65 and a right-side plate 66; a base plate 62; and a paper guide member 64. The left-side plate 65 and right-side plate 66 are disposed facing each other in the widthwise direction at a certain distance apart. The base plate 62 is suspended between the left-side plate 65 and right-side plate 66. As shown in FIGS. 1 and 4, the paper guide member 64 is suspended in a swingable manner between the left-side plate 65 and the right-side plate 66 above the front end of the base plate 62. The pickup roller 10, the paper supply roller 11, the rear conveyor roller 13*b*, the pair of registration rollers 14, the drive roller 36, the follower roller 37, and the transfer rollers 39 are suspended between the left-side plate 65 and the right-side plate 66 in a rotatable manner.

When the belt unit 60 is mounted in its installation position in the main casing 2 as shown in FIG. 1, the transfer rollers 39 are located exactly below the photosensitive drums 33 with the conveyor belt 38 being sandwiched therebetween, and the terminals 91 are in electrical connection with the electrodes 92 on the electrode holder 86.

In order to remove the belt unit 60 from the main casing 2, the belt unit 60 and the sheet supply cassette 70 are withdrawn in an integral unit in the forward direction as shown in FIG. 3. More specifically, a linear insertion/removal path 100 is defined in the main casing 2 as extending horizontally from the front portion of the main casing 2. By moving the belt unit 60 and the sheet supply cassette 70 together in a straight line along the linear insertion/removal path 100, the belt unit 60 and the sheet supply cassette 70 can be installed in or removed from the main casing 2 through the front side of the main casing 2.

More specifically, as shown in FIG. 5, each of the left main casing side plate 81 and the right main casing side plate 82 is formed with a belt unit guide 83 at its lower end. The belt unit guide 83 protrudes inward in the widthwise direction and extends in the front-to-rear direction by a length that is sufficiently long to receive the entire length of the belt unit frame 61 in the front-to-rear direction. Each belt unit guide 83 is formed with a guide portion 85. The guide portion 85 is a rectangular cutout formed on an upper edge of the belt unit guide 83. The guide portion 85 extends along the inner side of the belt unit guide 83 in the widthwise direction along the entire length of the belt unit guide 83 in the front-to-rear direction. The belt unit guides 83 define the linear insertion/removal path 100.

As shown in FIG. 5, the belt unit 60 is mounted in the main casing 2, with the lower end portion of the left-side plate 65 being located on the guide portion 85 of the left main casing side plate 81 and the lower end portion of the right-side plate 66 being located on the guide portion 85 of the right main casing side plate 82. The left-side plate 65 faces the left main casing side plate 81 with a predetermined spacing therebetween, and the right-side plate 66 facing the right main casing side plate 82 with a predetermined spacing therebetween. The belt unit 60 can slide horizontally along the guide portions 85.

It is noted that the lower end portion of each of the left-side plate 65 and the right-side plate 66 bends inward in the widthwise direction to form a sheet supply cassette guide 67. The sheet supply cassette guide 67 is for guiding the sheet supply cassette frame 71 so that the sheet supply cassette 70 can be inserted into or removed from the main casing 2.

Each of the left-side plate 72 and the right-side plate 73 has a stretched portion 75. The stretched portion 75 stretches out from an upper end of a corresponding plate 72 or 73 towards the outer side in the widthwise direction. The stretched portion 75 extends in the direction from front to rear. The stretched portion 75 of the left-side and right-side plate 72 can be engaged from above onto the paper supply unit guide 67 of the left-side plate 65. The stretched portion 75 of the right-side plate 73 can be engaged from above onto the paper supply unit guide 67 of the right-side plate 66. The sheet supply cassette frame 71 can therefore be held on the belt unit frame 61 so that the sheet supply cassette frame 71 is slidable horizontally along the paper supply unit guides 67.

When the sheet supply cassette frame 71 is held on the belt unit frame 61, the left-side plate 72 faces the left-side plate 65 with a predetermined spacing therebetween, and the right-side plate 73 faces the right-side plate 66 with a predetermined spacing therebetween.

The sheet conveying section 4 is established in the main casing 2 when the sheet supply cassette 70 and the belt unit 60 are properly mounted in their installation positions shown in FIG. 1.

In the sheet conveying section 4, the separation pad 3*a* is pressed into contact with the paper supply roller 11 by the spring force of the spring 3*b*.

The paper supply rollers 10 and 11 cooperate to separate the recording papers P that are held in a stack on the paper tray 9 one sheet at a time and supply the separated sheet in a direction toward the conveyor rollers 13. More specifically, the paper supply roller 10 serves as a pickup roller to convey the uppermost sheet of the recording paper P in the stack on the paper tray 9 towards the paper supply roller 11. The paper supply roller 11 is pressed against the separation pad 3*a*, and separates one sheet of the recording paper P at a time and conveys the same.

The front conveyor roller 13*a* and the rear conveyor roller 13*b* (which will be referred to as "a pair of conveyor rollers 13") and the pair of registration rollers 14 are disposed sequentially along the paper supply side U-shaped path 12. The pair of conveyor rollers 13 and the pair of registration rollers 14 convey the recording paper P along the paper supply side U-shaped path 12 from the paper supply roller 11 to a location between the belt unit 60 and the image-forming portions 17.

Before the image-forming portions 17 start their image-forming operations, the registration rollers 14 temporarily halt conveying the recording paper P, correct the orientation of the recording paper P by catching the leading edge thereof, and send the recording paper P to the location between the belt unit 60 and the image-forming portions 17 in the vicinity of the follower roller 37.

The paper supply side U-shaped path 12 extends from the sheet supply roller 11 toward the follower roller 37. The paper supply side U-shaped path 12 has: an upstream side part 12*a* defined between the sheet supply roller 11 and the conveyor rollers 13; a middle part 12*b* defined between the conveyor rollers 13 and the registration rollers 14; and a downstream side part 12*c* defined between the registration rollers 14 and the follower roller 37 along the paper guide member 64. The sheet supply roller 11 conveys a sheet P forwardly in the upstream side part 12*a* of the paper supply side U-shaped path 12. The conveyor rollers 13 convey the sheet P upwardly in the middle part 12*b* of the paper supply side U-shaped path 12. The registration rollers 14 convey the sheet P rearwardly along the paper guide member 64 in the downstream side part 12*c* of the paper supply side U-shaped path 12.

Thus, the sheet of paper P is first conveyed in the forward direction at the upstream side part 12*a* of the paper supply side U-shaped path 12. The sheet of paper P is then conveyed upwardly by the conveyor rollers 13 in the middle part 12*b* of the paper supply side U-shaped path 12. The conveying direction of the sheet of paper P is then reversed, while being adjusted in its orientation by the registration rollers 14. The sheet of paper P is then conveyed along the paper guide member 64 in the rearward direction at the downstream part 12*c* of the paper supply side U-shaped path 12. The sheet of paper P is then sent out from the paper supply side U-shaped path 12 to the location between the belt unit 60 and the image forming portions 17.

The drive roller 36 and the follower roller 37 are supported in the belt unit frame 61, with their axial directions being parallel with the axial directions of the photosensitive drums 33. The follower roller 37 is disposed at a position higher than and forward from the drive roller 36.

The conveyor belt 38 is an endless belt formed of a resin such as an electrically conductive polycarbonate or polyimide in which are dispersed electrically conductive particles such as those of carbon. The conveyor belt 38 is wound around the drive roller 36 and the follower roller 37.

The loop of the conveyor belt 38 has: an upper-side portion 38*a* that is disposed in the upper side of the drive roller 36 and the follower roller 37; and a lower-side portion 38*b* that is disposed in the lower side of the drive roller 36 and the follower roller 37. Both of the upper-side portion 38*a* and the lower-side portion 38*b* extend in a flat slope or inclination that increases in height toward the front. The upper-side portion 38*a* is in contact with the photosensitive drums 33 from below. The contact portions between the photosensitive drums 33 and the upper-side portion 38*a* of the conveyor belt 38 will be referred to as image transfer positions hereinafter.

The drive roller 36 is located at a position that is shifted rearwardly and downwardly from the photosensitive drum 33 in the black process cartridge 30K. The follower roller 37 is located at a position that is shifted forwardly and downwardly from the photosensitive drum 33 in the yellow process cartridge 30Y.

During image formation, the drive roller 36 is driven to rotate in the counterclockwise direction in FIG. 1, that is, in a direction opposite to that of the photosensitive drums 33. The conveyor belt 38 moves circumferentially around the drive roller 36 and the follower roller 37 to rotate in the counterclockwise direction. Accordingly, the upper side portion 38*a* moves at its image transfer positions in the same direction as the photosensitive drums 33.

The four transfer rollers 39 are disposed within the loop of the conveyor belt 38, that is, between the upper side portion 38*a* and the lower side portion 38*b* in the vertical direction. The transfer rollers 39 are suspended between the left-side plate 65 and the right-side plate 66 so that each transfer roller 39 is rotatable about its axis and is slidably movable in the vertical direction. The transfer rollers 39 are oriented, with their axial directions being parallel with the axial directions of the drive roller 36 and the follower roller 37. Accordingly, the axial directions of the transfer rollers 39 are parallel with those of the photosensitive drums 33.

Distances between the successive transfer rollers 39 are equal to the distances between the successive photosensitive drums 33. This ensures that when the belt unit 60 is mounted in its installation position in the main casing 2 as shown in FIG. 1, all the transfer rollers 39 are located exactly below the respective photosensitive drums 33 with the upper-side portion 38*a* of the conveyor belt 38 being sandwiched therebetween. Thus, the transfer rollers 39 are properly located at the image transfer positions where the upper side portion 38*a* of the conveyor belt 38 contacts the photosensitive drums 33.

Each transfer roller 39 has a metal roller shaft 39*a* covered with a roller portion 39*b* formed of an elastic substance such as an electrically conductive rubber material.

Figure 6:
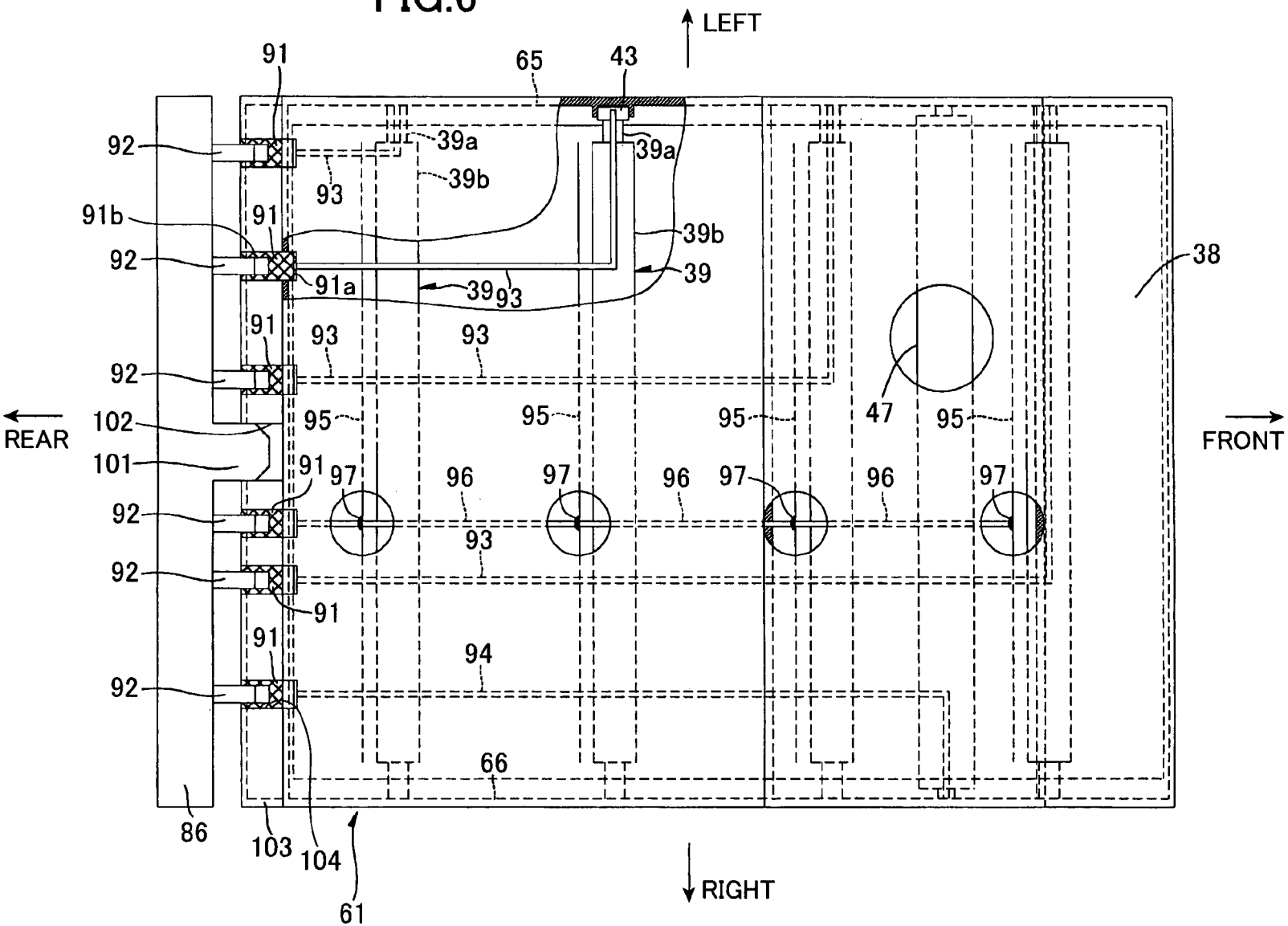
FIG. 6 is a bottom view of the belt unit.

As shown in FIG. 6, left-side and right-side ends of the roller shaft 39*a* of each transfer roller 39 are rotatably supported on the left-side and right-side plates 65 and 66 by left-side and right-side bearings 43, respectively. The left-side and right-side bearings 43 are supported as being slidingly movable in a vertical direction on the left-side and right-side plates 65 and 66, respectively.

Figure 7:
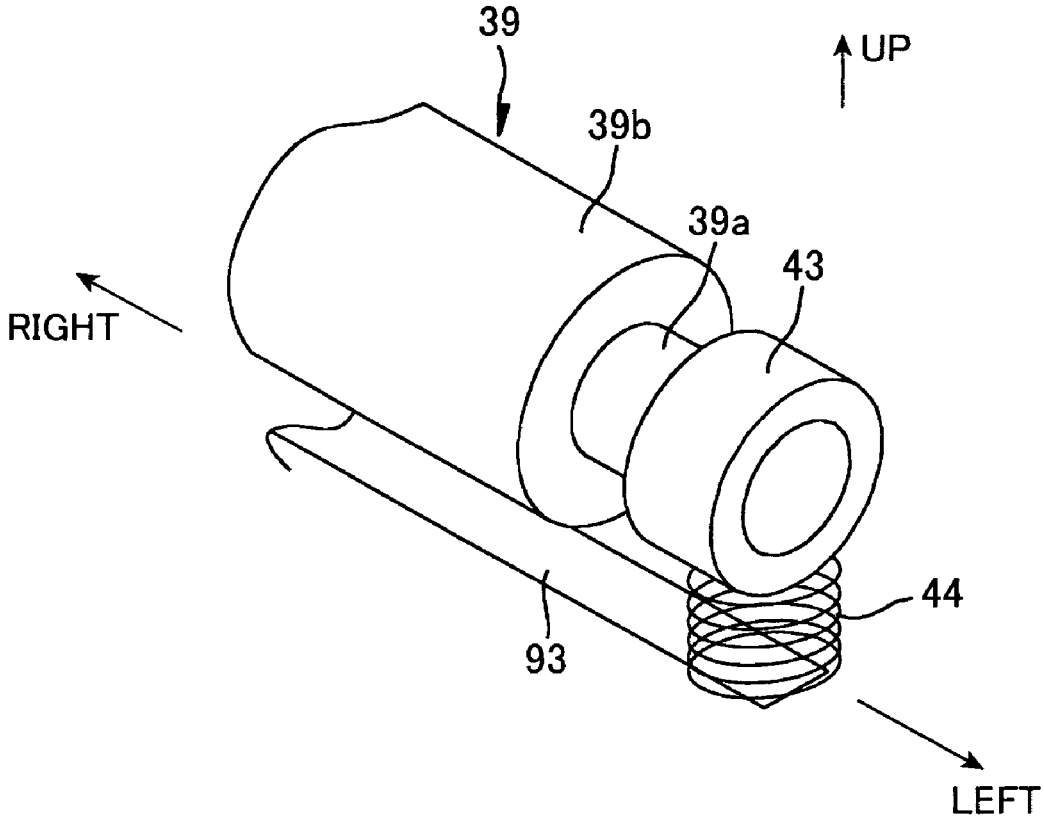
FIG. 7 is a perspective view of a left-side end portion of a transfer roller shown in FIG. 6.

More specifically, in correspondence with each transfer roller 39, left-side and right-side compression springs 44 are mounted on the left-side and right-side plates 65 and 66, respectively. The left-side and right-side compression springs 44 are fixed at their bottoms to the left-side and right-side plates 65 and 66, respectively. The left-side and right-side bearings 43 are mounted on the tops of the left-side and right-side compression springs 44, respectively. FIG. 7 shows how the left-side bearing 43 is supported on the left-side compression spring 44. It is noted that the right-side bearing 43 is supported on the right-side compression spring 44 in the same manner as shown in FIG. 7. Accordingly, the left-side and right-side bearings 43 are pressed upwardly by the left-side and right-side compression springs 44, respectively. Thus, the entire transfer rollers 39 are urged upwardly against the upper side portion 38*a* of the conveyor belt 38. Accordingly, when the belt unit 60 is located in the installation position as shown in FIG. 1, the transfer rollers 39 press the conveyor belt 38 upwardly against the lower sides of the photosensitive drums 33 to form the nips (image transfer positions) between the lower sides of the photosensitive drums 33 and the upper-side portion 38*a* of the conveyor belt 38. As described above, the photosensitive drums 33 are arranged with a line connecting the lower sides thereof extending forwardly upwardly at the predetermined angle of greater than zero (0) degree with respect to the rear-to-front direction as shown in FIG. 3. Accordingly, the upper side portion 38*a* of the conveyor belt 38 is also inclined forwardly upwardly along the line connecting the lower sides of the photosensitive drums 33.

It is noted that the left-side and right-side bearings 43 are electrically conductive, and the left-side and right-side compression springs 44 are also electrically conductive. During an image transfer operation, transfer bias is applied to each transfer roller 39 via a corresponding transfer bias line 93, the left-side compression spring 44, and the left-side bearing 43 as will be described later with reference to FIG. 7. Each transfer roller 39 rotates counterclockwise in FIG. 1, and therefore moves in the same direction as the conveyor belt 38 at its image transfer position.

The paper P that has been sent out from the paper supply side U-shaped path 12 is conveyed from the front to the rear by the conveyor belt 38, which is moved circumferentially by the driving of the drive roller 36 and movement of the follower roller 37, to sequentially pass the image transfer positions between the conveyor belt 38 and the photosensitive drum 33 of the image-forming portions 17. During the conveying, a toner image of each color that is supported on the corresponding photosensitive drum 33 of each image-forming portion 17 is sequentially transferred to the paper P, and thus a multi-color image is formed on the paper P.

More specifically, a multi-color image is formed on the paper P by first transferring onto the paper P a yellow toner image, which is supported on the surface of the photosensitive drum 33 of the yellow image-forming portion 17Y, then transferring a magenta toner image, which is supported on the surface of the photosensitive drum 33 of the magenta image-forming portion 17M, onto the magenta toner image that has already been transferred to the paper P, similarly transferring a cyan toner image, supported on the surface of the photosensitive drum 33 of the cyan image-forming portion 17C, and finally transferring a black toner image, supported on the surface of the photosensitive drum 33 of the black image-forming portion 17K, onto the previous images thereon.

As shown in FIG. 1, the base plate 62 has a front area 62*a* and a middle-to-rear area 62*b*, which are arranged in the front-to-rear direction. The front area 62*a* faces the follower roller 37. The middle-to-rear area 62*b* is positioned lower than the front area 62*a*, and therefore defines thereon a depression 103 that sinks lower than the front area 62*a*. The belt cleaning device 40 is disposed within a front portion in the depression 103. Thus, the belt cleaning device 40 is disposed below the conveyor belt 38 in a comparatively large space within the depression 103 that is formed near to the follower roller 37 side.

The belt cleaning device 40 has a cleaning box 46 and a cleaning roller 47. The cleaning box 46 has a box shape, and is formed with an aperture at its part that faces the lower side portion 38*b* of the conveyor belt 38. The interior space of the cleaning box 46 is formed as a collection portion for collecting objects that have been attached to the conveyor belt 38 and that are removed from the conveyor belt 38 by the cleaning roller 47.

The cleaning roller 47 is a metal roller that is rotatably supported in the cleaning box 46 at its aperture portion, and is in contact with the under surface of the lower side portion 38*b* of the conveyor belt 38. During the cleaning operation, a cleaning bias is applied to the cleaning roller 47 via a cleaning bias line 94 (which will be described later with reference to FIG. 6). The cleaning roller 47 is driven to rotate in the counterclockwise direction in FIG. 1. Accordingly, the cleaning roller 47 moves in a direction opposite to the direction of motion of the conveyor belt 38 at its portion where the cleaning roller 47 contacts the conveyor belt 38.

It is noted that toner adheres to the conveyor belt 38 when the conveyor belt 38 contacts the photosensitive drum 33. Paper dust adheres to the conveyor belt 38 when the paper P contacts the conveyor belt 38. Objects such as toner and paper dust are captured by the cleaning roller 47 by an electrostatic force when the conveyor belt 38 brings the objects at a location opposing the cleaning roller 47. The thus-captured objects are removed from the cleaning roller 47 and are collected in the collection portion within the cleaning box 46.

In this way, when the cleaning roller 47 comes into contact with the under surface of the lower side portion 38*b* of the conveyor belt 38, the cleaning roller 47 collects toner and paper dust that has been adhered to the surface of the conveyor belt 38.

As shown in FIG. 1, the electrode holder 86 is disposed in the main casing 2 at a location that the electrode holder 86 faces a rear edge of the belt unit frame 61 when the belt unit 60 is installed at the installation position shown in FIG. 1. As shown in FIG. 6, a plurality of (six, in this example) electrodes 92 are held in the electrode holder 86. The electrodes 92 are arrayed in the widthwise direction. As shown in FIG. 1, each electrode 92 extends forward and has a contact point 92*a* that protrudes upwardly. A positioning protrusion 101 protrudes forwardly from the front surface of the electrode holder 86 at its central portion in the widthwise direction. The positioning protrusion 101 has a substantially rectangular shape as seen from the bottom as shown in FIG. 6.

As shown in FIGS. 1 and 6, a positioning groove 102 and a plurality of (six, in this example) terminal grooves 104 are formed at the rear edge of the base plate 62. As shown in FIG. 1, each terminal groove 104 is defined by a vertical wall 104*a* and a horizontal wall 104*b*. Terminals 91 are provided in the rear edge of the belt unit frame 61 within the respective terminal grooves 104. Each terminal 91 serves as a power supply terminal that is brought into contact with the corresponding electrode 92 when the belt unit 60 is installed in the main casing 2 at the installation position shown in FIG. 1.

As shown in FIG. 1, each terminal 91 is of an L-shape side section, and has a vertically-extending portion 91*a* and a horizontally-extending portion 91*b*. The vertically-extending portion 91*a* is located inside the belt unit frame 61 and extends vertically along the front-facing surface of the vertical wall 104*a* of the terminal groove 104. At the upper end of the vertically-extending portion 91*a*, the terminal 91 bends rearwardly so that the horizontally-extending portion 91*b* passes through the vertical wall 104*a* to protrude from the inside of the belt unit frame 61 outwardly to the outside of the belt unit frame 61. The horizontally-extending portion 91*b* extends horizontally (rearwardly) along an underside surface of the horizontal wall 104*b* of the terminal groove 104. Thus, the under surface of the horizontally-extending portion 91*b* of each terminal 91 can contact the contact point 92*a* of the corresponding electrode 92 when the belt unit frame 61 is installed in the main casing 2 at the installation position shown in FIG. 1. It is noted that each terminal 91 has a rear side edge 91*c* that is defined as a rear side edge of the horizontally-extending portion 91*b*. The under surface of the horizontally-extending portion 91*b* extends smoothly from the rear side edge 91*c* toward the vertically-extending portion 91*a*.

The distance between the rear side edges 91*c* and each transfer roller 39 is greater than the distance between the contact points 92*a* and the corresponding photosensitive drum 33. Accordingly, when the belt unit 60 is inserted in the main casing 2 from its front side and is moved rearwardly, after the terminals 91 come into contact with the contact points 92*a* of the electrodes 92 at their rear edges 91*c*, the transfer rollers 39 reach the positions exactly below the corresponding photosensitive drums 33 as shown in FIG. 1.

More specifically, when the belt unit 60 is inserted in the main casing 2 from its front side and is moved rearwardly, first, the contact points 92*a* of the electrodes 92 come into contact with the rear edges 91*c* of the horizontally-extending portions 91*b* of the terminals 91, and then slides against the under surfaces of the horizontally-extending portions 91*b* while keeping in contact therewith until the belt unit 60 finally reaches the installation position of FIG. 1, where the transfer rollers 39 reach the positions exactly below the corresponding photosensitive drums 33 and the conveyor belt 38 is brought into contact with the photosensitive drums 33. When the belt unit 60 finally reaches the installation position of FIG. 1, the contact points 92*a* are in contact with the under surface of the horizontally-extending portion 91*b* at a position that is located forward from the rear side edges 91*c* and rearward from the horizontal wall 104*b*.

Thus, when the belt unit 60 is inserted in the main casing 2 and is moved rearwardly, the belt unit 60 reaches the installation position of FIG. 1 after the contact points 92*a* of the electrodes 92 have come into contact with the terminals 91.

On the other hand, when the belt unit 60 is moved in the forward direction to be separated away from the installation position, the conveyor belt 38 becomes first separated from the photosensitive drums 33. Then, the horizontally-extending portions 91*b* of the terminals 91 slide against the contact points 92*a* of the electrodes 92, while keeping contact with the contact points 92*a*. Then, the rear edges 91*c* of the terminals 91 reach the positions exactly above the contact points 92*a* of the electrodes 92. Finally, the rear edges 91*c* of the terminals 91 become separated from the contact points 92*a* of the electrodes 92.

It is noted that the distance between the rear edges 91*c* and each transfer roller 39 may be equal to the distance between the contact points 92*a* and the corresponding photosensitive drum 33. In this case, when the belt unit 60 is inserted in the main casing 2 from its front side and is moved rearwardly, simultaneously when the contact points 92*a* of the electrodes 92 come into contact with the rear edges 91*c* of the terminals 91, the belt unit 60 reaches the installation position of FIG. 1 where the transfer rollers 39 reach the positions exactly below the corresponding photosensitive drums 33 and the conveyor belt 38 is brought into contact with the photosensitive drums 33. On the other hand, when the belt unit 60 is moved in the forward direction to be separated away from the installation position, the conveyor belt 38 becomes separated from the photosensitive drums 33 simultaneously when the rear edges 91*c* of the terminals 91 become separated from the contact points 92*a* of the electrodes 92.

As shown in FIG. 6, the positioning protrusion 101 fits into the positioning groove 102 when the belt unit frame 61 is installed in the main casing 2. The belt unit frame 61 can be properly positioned with respect to the main casing 2 in the widthwise direction by fitting the positioning protrusion 101 into the positioning groove 102. Erroneous positioning, in the widthwise direction, of the terminals 91 with respect to the electrodes 92 can be prevented by using the positioning protrusion 101 as reference for positioning the belt unit frame 61 with respect to the main casing 2 in the widthwise direction. For that reason, reliable connections can be achieved between the terminals 91 and the corresponding electrodes 92.

Figure 8:
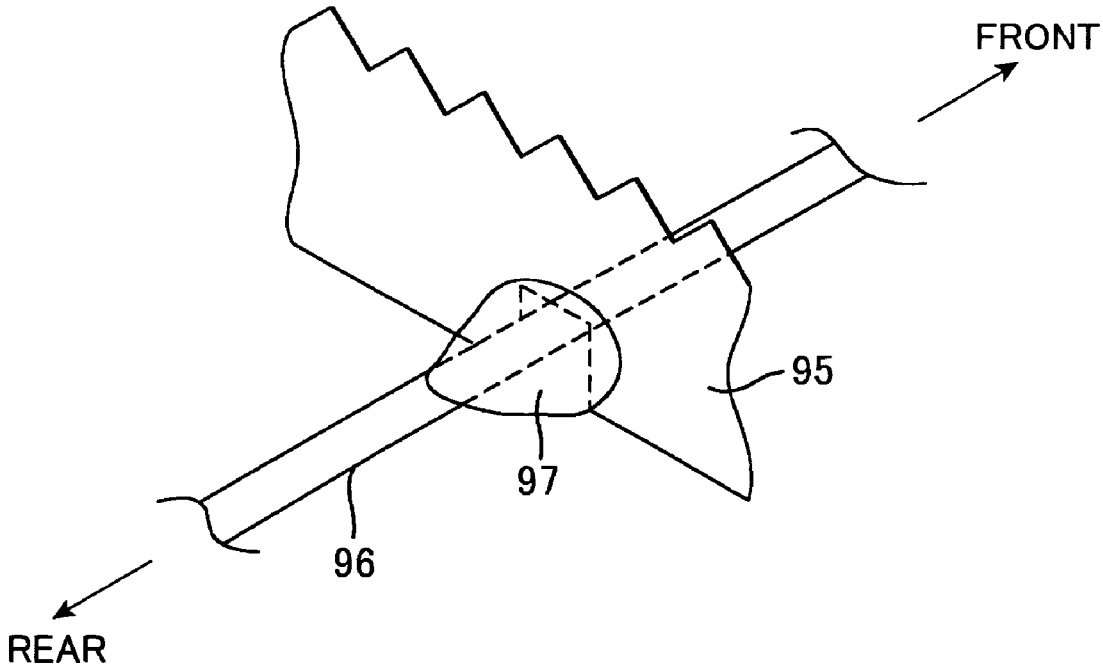
FIG. 8 is a perspective view showing a connection between a neutralization bias line and a neutralization comb shown in FIG. 6.

As shown in FIG. 6, the belt unit frame 61 further supports therein neutralization combs 95 for the image-forming portions 17K, 17C, 17M, and 17Y, respectively. Each neutralization comb 95 is located to extend along a corresponding transfer roller 39. The neutralization combs 95 as well as the transfer rollers 39 are located within the loop of the conveyor belt 38, that is, between the upper side portion 38*a* and the lower side portion 38*b* of the endless belt 38. The neutralization combs 95 are for removing electric charges from the conveyor belt 38. The upper edge portion of each neutralization comb 95 is formed with a large number of mountain-shaped protrusions as shown in FIG. 8, and comes into contact with the under surface of the upper side portion 38*a* of the conveyor belt 38.

In this example, the conveyor belt 38 is configured of a plurality of strips of endless belts, which are wound around the drive roller 36 and the follower roller 37 and which are arranged adjacent to one another in the widthwise direction. A small amount of widthwise gap (inter-strip gap) is formed between each two adjacent strips of endless belt in the widthwise direction.

As shown in FIG. 6, the belt unit frame 61 further supports therein: the four transfer bias lines 93 for supplying a transfer bias to the four transfer rollers 39; the cleaning bias line 94 for supplying a cleaning bias to the cleaning roller 47; and a neutralization bias line 96 for supplying a neutralization bias to the neutralization combs 95.

The neutralization bias line 96 has a rear end that is connected to one of the terminals 91. Because the terminals 91 are located outside the loop of the conveyor belt 38, the neutralization bias line 96 passes through the lower side portion 38*b* of the conveyer belt 38 via one inter-strip gap, entering the space within the loop of the conveyer belt 38. The neutralization bias line 96 then extends forwardly, while being connected with the neutralization combs 95 for the image-forming portions 17K, 17C, 17M, and 17Y in succession.

As shown in FIG. 8, each neutralization comb 95 is formed with a through-hole, through which the neutralization bias line 96 passes. The neutralization comb 95 is electrically connected to the neutralization bias line 96 via electrically-conductive material 97 such as solder.

Each transfer bias line 93 is connected at its rear end to one of the terminals 91 other than the terminal 91 for the neutralization bias line 96, and is connected at its front end to a corresponding transfer roller 39. Similarly to the neutralization bias line 96, each transfer bias line 93 passes through the lower side portion 38*b* of the conveyer belt 38 via one inter-strip gap, entering the space within the loop of the conveyer belt 38. Each transfer bias line 93 then extends forwardly, and is finally bent to extend leftwardly. The terminal end of each transfer bias line 93 is connected to the bottom end of the left-side compression spring 44 as shown in FIG. 7. Thus, each transfer bias line 93 is electrically connected to the corresponding transfer roller 39 via the corresponding left-side compression spring 44 and the corresponding left-side bearing 43. Each transfer bias line 93 applies a transfer bias to the corresponding transfer roller 39.

The cleaning bias line 94 is connected at its rear end to one terminal 91 other than the terminals for the transfer rollers 39 and for the neutralization bias line 96, and is connected at its front end to a right-side end of the cleaning roller 47.

<Fixing Section 19>

The heating roller 48 is configured of a metal tube with a release layer formed on the surface thereof. The heating roller 48 accommodates therein a halogen lamp extending along the direction of the axis of the heating roller 48. The halogen lamp heats the surface of the heating roller 48 to a fixing temperature. The pressure roller 49 contacts the heating roller 48 with pressure. The recording paper P with the multicolor image formed thereon is sent out from the conveyor belt 38, and passes in between the heating roller 48 and the pressure roller 49. As a result, the multicolor image is thermally fixed onto the sheet of paper P with pressure.

<Sheet Discharging Section 6>

The sheet discharge side U-shaped path 50 is formed as a substantially U-shaped conveying path for a paper P. The sheet discharge side U-shaped path 50 extends upward from its upstream end portion toward its downstream end portion. The upstream end portion of the sheet discharge side U-shaped path 50 is in the vicinity of the fixing section 19. The downstream end portion of the sheet discharge side U-shaped path 50 is in the vicinity of the sheet discharge tray 52. The sheet discharge rollers 51 are configured from a pair of rollers. The sheet discharge rollers 51 are located at the end of the downstream side of the sheet discharge side U-shaped path 50 and above the hinge 52*a*.

The paper P supplied from the fixing section 19 is conveyed rearward in the upstream end portion of the sheet discharge side U-shaped path 50, is reversed in its conveying direction within the sheet discharge side U-shaped path 50, is delivered forward by the sheet discharge rollers 51 in the downstream end portion of the sheet discharge side U-shaped path 50, and is finally discharged out onto the sheet discharge tray 52.

As described above, by sliding the belt unit frame 61 along the guide portions 85 of the belt unit guides 83, the belt unit 60 can be inserted into or removed from the main casing 2 along the linear insertion/removal path 100, which extends horizontally from the front as shown in FIG. 3. The belt unit 60 can be inserted into or removed from the main casing 2 together with the sheet supply cassette 70.

More specifically, as shown in FIGS. 2 and 3, the belt unit 60 and the sheet supply cassette 70 are disposed to partly overlap with each other in the horizontal direction. Accordingly, when the belt unit 60 is desired to be removed from the main casing 2 as shown in FIG. 3, by pulling out the belt unit 60 forwardly, the lower front portion of the belt unit 60 push forward the sheet supply cassette 70, thereby enabling the belt unit 60 and the sheet supply cassette 70 to be removed together from the main casing 2. When the belt unit 60 and the sheet supply cassette 70 are desired to be mounted into the main casing 2, by pushing the front surface of the sheet supply cassette 70 rearwardly, the upper front portion of the sheet supply cassette 70 pushes rearward the belt unit 60, thereby enabling the belt unit 60 and the sheet supply cassette 70 to be mounted together in the main casing 2. In this way, the integral unit of the belt unit 60 and the sheet supply cassette 70 are inserted into or removed from the main casing 2 in the same direction as that in which the sheet supply cassette 70 alone is inserted or removed. For that reason, the belt unit 60 and the sheet supply cassette 70 can be inserted or removed by a single operation. As a result, the ease of operation during the insertion or removal of the belt unit 60 and the sheet supply cassette 70 can be improved.

As described above, when the belt unit 60 is mounted in the installation position of FIG. 1, the upper side portion 38*a* of the conveyor belt 38 is inclined forwardly upwardly along the line connecting the lower sides of the photosensitive drums 33. In other words, the angle different from zero (0) degree is formed between the direction, in which the upper side portion 38*a* moves according to the driving of the drive roller 36, and the horizontal direction, in which the belt unit 60 is withdrawn from the color laser printer 1. This ensures that the nips between the surface of the conveyor belt 38 and the photosensitive drums 33 are released simultaneously when the belt unit 60 is moved from the installation position of FIG. 1 in the forward direction as shown in FIG. 3.

When the belt unit 60 is mounted in the main casing 2 at the installation position shown in FIG. 1, each transfer roller 39 is urged upwardly by the compression springs 44 with the upper-side portion 38*a* of the conveyor belt 38 being sandwiched between the transfer roller 39 and the corresponding photosensitive drum 33. The direction of motion at the withdrawal of the belt unit 60 from the installation position is the horizontal direction, and is orthogonal to the direction, in which the transfer rollers 39 are urged by the compression springs 44. Accordingly, when the belt unit 60 is moved forwardly from the installation position to be withdrawn from the main casing 2 as shown in FIG. 3, the transfer rollers 39 move upward by an amount B due to the elastic force of the compression springs 44, and thus the upper-side portion 38*a* of the conveyor belt 38 rises by the amount B upward, that is, in the direction in which the compression springs 44 act.

According to the present embodiment, the amount of rise B of the upper-side portion 38*a* of the conveyor belt 38 and the offset amount A between the lower edges of the adjacent photosensitive drums 33 have such a relationship that a value C obtained by subtracting the amount of rise B from the offset amount A is greater than zero. In other words, the offset amount A is greater than the amount of rise B. For that reason, when the belt unit 60 is moved forwardly from the installation position to be withdrawn from the main casing 2, a gap is formed between the conveyor belt 38 and the lower edges of the photosensitive drums 33. The conveyor belt 38 does not contact the lower edges of the photosensitive drums 33. Accordingly, a sliding contact between the conveyor belt 38 and the photosensitive drums 33 can be prevented reliably, even though the conveyor belt 38 rises. As a result, damage to the photosensitive drum 33 or the conveyor belt 38 due to rubbing between the conveyor belt 38 and the photosensitive drums 33 can be prevented.

Because the photosensitive drums 33 are arranged along the direction of motion of the conveyor belt 38, the contacts between the conveyor belt 38 and the photosensitive drums 33 are released simultaneously with one another by motion of the belt unit 60 in the direction of withdrawal. No additional operation of moving the belt unit 60 in a direction crossing or traversing the direction of the motion is required. Accordingly, the ease of operation during the removal of the belt unit 60 from the main casing 2 can be improved.

As described above, according to the present embodiment, the color laser printer 1 is of a tandem type, in which the plurality of image forming portions 17 are provided one for each color. Accordingly, formation of images for each color is executed at substantially the same speed as that of a monochromatic image, making it possible to form a multi-color image rapidly. For that reason, a multi-color image can be formed, while keeping the device compact.

The direction D, along which the process cartridges 30 are inserted or removed, is inclined in both the horizontal direction (front-to-rear direction) and the vertical direction (the thickness direction of the paper P that is conveyed by the conveyor belt 38). In other words, the direction D is inclined upwardly with respect to the forward direction. Thus the ease of operation of inserting or removing the process cartridges 30 can be improved.

Furthermore, the process cartridges 30 and the scanner units 20 are disposed alternately in the front-to-rear direction in the color laser printer 1. This efficient disposition can make the entire device 1 compact.

The drive roller 36 is disposed on the downstream side and the follower roller 37 is disposed on the upstream side in the direction of motion of the upper side portion 38*a* of the conveyor belt 38 at the image transfer positions. Accordingly, slackening can be prevented in the upper side portion 38*a* of the conveyor belt 38. For that reason, the paper P can be conveyed accurately by the upper side portion 38*a* of the conveyor belt 38.

The sheet supply cassette 70 can be inserted or removed horizontally from the front of the main casing 2, by sliding the sheet supply cassette frame 71 along the paper supply unit guides 67 as shown in FIG. 2. This ensures that the sheet supply cassette 70 alone can be inserted into and removed from the main casing 2, as shown in FIG. 2.

Because the belt unit 60 and the sheet supply cassette 70 are disposed to partly overlap with each other in the horizontal direction, the entire size of the integral unit of the belt unit 60 and the sheet supply cassette 70 in the vertical direction is small. The entire size of the color laser printer 1 in the vertical direction can be made small.

Moreover, when both the belt unit 60 and the sheet supply cassette 70 are withdrawn from the main casing 2 as shown in FIG. 3, a large space is formed below the image-forming section 5. When a paper P is jammed in the fixing section 19, for example, a user can easily remove the paper P from the inside of the main casing 2 by inserting his/her hand into the large space from the front.

As shown in FIG. 3, the insertion/removal path 100 extends horizontally without bending, and the belt unit 60 can be moved in a straight line from the start of withdrawal from the main casing 2 to the completion thereof. In addition, the belt unit 60 can be moved along the insertion/removal path 100 in a straight line with respect to the main casing 2 from the start of installation to the completion thereof. For that reason, the operation of inserting or removing the belt unit 60 with respect to the main casing 2 can be done extremely easily.

After withdrawing the belt unit 60 from the main casing 2 as shown in FIG. 4, by turning the paper guide member 64 upwardly, it becomes possible to raise the conveyor belt 38 and the belt cleaning device 40 from the belt unit 60, either together or separately, and take the conveyor belt 38 and the belt cleaning device 40 out of the belt unit frame 61. This facilitates the replacement or maintenance of the conveyor belt 38 and the belt cleaning device 40.

According to the present embodiment, the belt unit 60 including the conveyor belt 38 is removable along the linear insertion/removal path 100 from the main casing 2. In addition, an angle formed between the direction, in which the upper side portion 38*a* of the conveyor belt 38 moves by the drive roller 36, and the direction, in which the belt unit 60 is withdrawn, is such that contacts between the conveyor belt 38 and the photosensitive drums 33 are released by the withdrawal of the belt unit 60.

That is, the upper side portion 38*a* of the conveyor belt 38 is inclined upwardly with respect to the forward direction (the direction of withdrawal of the belt unit 60), and the upper side portion 38*a* contacts the photosensitive drums 33 from their front lower sides. This ensures that the withdrawal or movement of the belt unit 60 in the forward direction immediately releases the contacts between the surface of the conveyor belt 38 and the photosensitive drums 33. Accordingly, no additional operation is required to move the belt unit 60 in a direction traversing the horizontal direction in order to separate the conveyor belt 38 from the photosensitive drums 33, and thus the ease of operation during the withdrawal of the belt unit 60 from the main casing 2 can be improved.

Similarly, when the belt unit 60 is inserted into the main casing 2, installing the belt unit 60 along the linear insertion/removal path 100 ensures that the surface of the conveyor belt 38 comes into contact with the photosensitive drums 33 only when the belt unit 60 is installed completely. In this way, the conveyor belt 38 comes into contact with the photosensitive drums 33 after the belt unit 60 has completed moving in the direction along the insertion/removal path. No additional operation of moving the belt unit 60 in a direction crossing or traversing the horizontal direction is required, and thus the ease of operation during the installation of the belt unit 60 into the main casing 2 can also be improved.

In this way, no additional motion of the belt unit 60 across the direction of motion along the insertion/removal path 100 is necessary during the insertion or removal of the belt unit 60 with respect to the main casing 2. Accordingly, the configuration for guiding the belt unit 60 can be simplified, enabling a reduction in production costs.

Since the direction in which the belt unit 60 is inserted or withdrawn is substantially horizontal, the belt unit 60 can be inserted or withdrawn in a simple manner from the main casing 2.

In addition, since the belt unit 60 is withdrawn in the direction orthogonal to the rotational shafts 33*a* of the photosensitive drums 33 and to the rotational shafts 39*a* of the transfer rollers 39, the contacts between the surface of the conveyor belt 38 and the photosensitive drums 33 can be released immediately after the belt unit 60 has started moving in the direction of withdrawal from the installation position of the belt unit 60. For that reason, sliding contact between the conveyor belt 38 and each photosensitive drum 33 can be prevented. Thus damage to the photosensitive drums 33 or the conveyor belt 38 due to sliding contact between the conveyor belt 38 and the photosensitive drums 33 can be prevented.

The photosensitive drums 33 are arranged in a direction parallel with the direction of motion of the conveyer belt 38 of the belt unit 61. The conveyor belt 38 separates from the photosensitive drums 33 simultaneously with one another when the belt unit frame 61 starts moving from the installation position of FIG. 1 in the withdrawal direction.

Since the motion of the belt unit 60 is guided by the belt unit guides 83, the belt unit 60 can be withdrawn in a simple manner from the main casing 2. This enables an improvement in the ease of operation of the insertion and removal of the belt unit 60.

Furthermore, since the terminals 91 are provided at the end of the belt unit 60 on the downstream side in the direction of installation, the terminals 91 are not exposed until the belt unit 60 has been completely removed from the main casing 2. Thus the user can be prevented from touching the terminals 91.

In addition, since the electrodes 92 are disposed in the main casing 2 on its downstream side in the direction of installation of the belt unit 60, the user can be prevented from touching the electrodes 92. Thus contamination of the terminals 91 and the electrodes 92 can be prevented.

Since the terminals 91 are disposed in an array in the widthwise direction and the electrodes 92 are also disposed in an array in the widthwise direction, connections between the plurality of terminals 91 and the electrodes 92 can be achieved simultaneously with one another when the belt unit 60 is installed in the main casing 2.

The terminals 91 and the electrodes 92 are disposed in a positional relationship such that during the installation of the belt unit 60 into the main casing 2, the conveyor belt 38 comes into contact with the photosensitive drums 33 either simultaneously with or after the connections between the terminals 91 and the electrodes 92 are attained. Accordingly, after the conveyor belt 38 has come into contact with the photosensitive drums 33, it is unnecessary to move the belt unit 60 further in the rearward direction to make the connections between the terminals 91 and the electrodes 92. Sliding contacts between the conveyor belt 38 and the photosensitive drums 33 can be prevented. Thus damage to the photosensitive drums 33 or the conveyor belt 38 due to sliding contact between the conveyor belt 38 and the photosensitive drums 33 can be prevented.

The paper supply roller 11 picks up the sheet P in the forward direction, the upper-side portion 38*a* of the conveyor belt 38 conveys the sheet P in the rearward direction, and the sheet discharge rollers 51 discharges the sheet P in the forward direction. Accordingly, the size of the entire printer 1 can be made small.

While the invention has been described in detail with reference to the specific embodiment thereof, it would be apparent to those skilled in the art that various changes and modifications may be made therein without departing from the spirit of the invention.

In the above-described embodiment, the conveyor belt 38 is made up from the plurality of belt strips, which are arranged in the widthwise direction, with inter-strip gaps being formed therebetween. However, the conveyor belt 38 may be made up from a single conveyor belt with no gaps therein.

In this case, each bias line 93 is modified to first extend from the terminal 91 leftwardly in the widthwise direction toward the left-side edge of the conveyor belt 38, then bend upwardly to pass through the gap between the left-side edge of the conveyor belt 38 and the left-side plate 65, before finally reaching the left-side end of the corresponding transfer roller 39. The bias line 96 may be modified similarly to the bias line 93.

The terminals 91 may further include a terminal for electrically grounding the belt unit frame 61.

Figure 9:
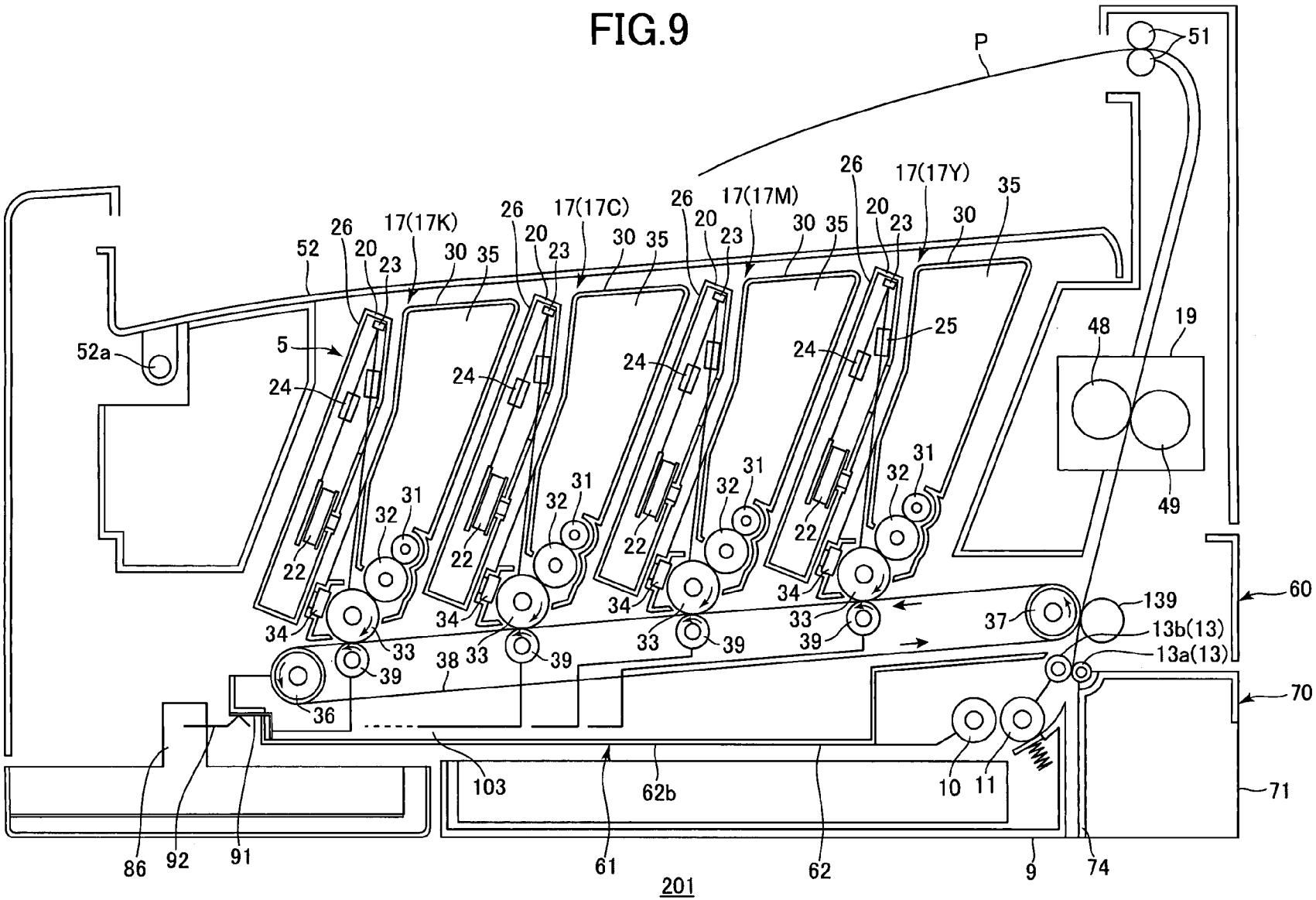
FIG. 9 is a sectional side view of a modification of the embodiment.

The configuration of the present embodiment can be modified into a color laser printer 201 shown in FIG. 9 such that the conveyor belt 38 acts as an intermediate transfer belt. That is, toner is transferred from the photosensitive drums 33 onto the conveyor belt 38 temporarily, before being finally transferred onto the recording paper P from the conveyor belt 38.

More specifically, in this modification, an additional transfer roller 139 is mounted in the belt unit 60 so that the conveyor belt 38 is sandwiched between the additional transfer roller 139 and the follower roller 37. The additional transfer roller 139 is applied with a transfer bias.

Toner images of all the four colors are superimposed one on another on the upper side portion 38*a* of the conveyor belt 38, while being conveyed in the rearward direction. Then, the toner images are conveyed by the lower side portion 38*b* of the conveyor belt 38 in the forward direction, before finally reaching the nip portion between the conveyor belt 38 and the additional transfer roller 139. The toner images and one sheet of paper P supplied from the conveyor rollers 13 pass through the nip portion simultaneously with each other, and the toner images are transferred onto the paper P.

In the above-described embodiment and modification, images are formed by using four colors of yellow, magenta, cyan, and black. However, images may be formed by using only three colors of yellow, magenta, and cyan, by using only two colors, or by using just one color.

The present invention can be applied to other various different types of image-forming device, such as an image-forming device provided with a facsimile function.

Each transfer bias line 93 may be connected to both of the right-side and left-side ends of the corresponding transfer roller 39 via the compression springs 44.

What is claimed is:

1. An image-forming device, comprising:

a housing defining a linear insertion/removal path and defining an installation position on the linear insertion/removal path, an insertion direction and a removal direction being defined along the linear insertion/removal path as opposed to each other;

at least one photosensitive member that is mounted in the housing and that forms a developer image thereon; and a belt unit that is detachably mounted in the housing, the belt unit being movable along the linear insertion/removal path, the belt unit moving to the installation position along the linear insertion/removal path in the insertion direction when the belt unit is mounted in the housing, the belt unit moving from the installation position along the linear insertion/removal path in the removal direction to be detached from the housing, the belt unit comprising:

a plurality of rollers; and an endless belt that is supported by the plurality of rollers, the endless belt being capable of moving circumferentially around the plurality of rollers, a surface of the endless belt contacting a surface of the at least one photosensitive member when the belt unit is located in the installation position, the endless belt moving in a belt-moving direction at a contact position where the endless belt contacts each photosensitive member, the belt-moving direction being angularly shifted from the removal direction to allow the surface of the endless belt to separate from each photosensitive member when the belt unit starts moving in the removal direction from the installation position.

2. An image-forming device as claimed in claim 1, wherein an angle different from zero (0) degree is formed between the belt-moving direction and the removal direction.

3. An image-forming device as claimed in claim 1, wherein the linear insertion/removal path extends substantially in the horizontal direction.

4. An image-forming device as claimed in claim 1, wherein the plurality of rollers are arranged, with their axial directions being arranged parallel with one another, wherein each photosensitive member is rotatable about its axis that extends substantially parallel with the axial directions of the plurality of rollers; and the removal direction is substantially perpendicular to the axis of each photosensitive member.

5. An image-forming device as claimed in claim 1, wherein the housing includes a guide member that guides the belt unit along the insertion/removal path.

6. An image-forming device as claimed in claim 1, further comprising a cassette that accommodates a recording medium and that is detachably installed in the housing, the cassette being capable of being withdrawn from the housing in a direction the same as the removal direction of the belt unit.

7. An image-forming device as claimed in claim 6, wherein the belt unit and the cassette are removable together from the housing.

8. An image-forming device as claimed in claim 6, wherein when the belt unit is installed in the housing at the installation position, the belt unit having a partly overlapping condition with the cassette in the removal direction of the belt unit.

9. An image-forming device as claimed in claim 1, wherein the belt unit includes a power supply terminal, the power supply terminal being located at an end portion of the belt unit at a downstream side of the insertion direction of the belt unit.

10. An image-forming device as claimed in claim 9, wherein the power supply terminal includes a plurality of power supply terminals that are arranged along the axial direction of the rotational shafts of the rollers.

11. An image-forming device as claimed in claim 10, wherein the housing includes a plurality of electrodes that are connected to the power supply terminals when the belt unit is installed at the installation position, when the belt unit is moved in the insertion direction toward the installation position in the housing, the endless belt contacting the at least one photosensitive member after the power supply terminals have been connected to the electrodes.

12. An image-forming device as claimed in claim 11, wherein the power supply terminal extends in the insertion direction and has a downstream side edge in the insertion direction, a distance between the downstream side edge of the power supply terminal and the contact position of the endless belt, at which the endless belt contacts the at least photosensitive member, is longer than a distance between the electrodes and the at least one photosensitive member.

13. An image-forming device as claimed in claim 9, wherein the belt unit further comprises at least one transfer roller in one to one correspondence with the at least one photosensitive member, the power supply terminal includes a transfer bias terminal that supplies the transfer roller with a transfer bias to transfer the developer image from each photosensitive member in a direction toward the endless belt.

14. An image-forming device as claimed in claim 13, wherein the belt unit further comprises:

a cleaning roller that cleans the endless belt;

a neutralization unit that neutralizes the endless belt; and a belt unit frame that supports the plurality of rollers, the at least one transfer roller, the cleaning roller, and the neutralization unit, the power supply terminal further includes at least one of:

a cleaning bias terminal that supplies the cleaning roller with a cleaning bias to clean the endless belt;

a neutralization bias terminal that supplies the neutralization unit with a neutralization bias to electrically neutralize the endless belt; and a ground terminal that electrically grounds the belt unit frame.

15. An image-forming device as claimed in claim 14, wherein a position of each photosensitive member, with respect to an orthogonal direction that is orthogonal both to the removal direction and to the rotational axial directions of the rollers, is offset by an offset amount from another photosensitive member that is located in an upstream side of the each photosensitive member in the removal direction, and wherein the belt unit further comprises an urging unit that causes, when the belt unit is moved from the installation position in the removal direction, contact portions of the endless belt, at which the endless belt contacts the photosensitive members when the belt unit is located at the installation position, to move by a moving amount in the orthogonal direction, the moving amount being smaller than the offset amount.

16. An image-forming device as claimed in claim 1, wherein the at least one photosensitive member includes a plurality of photosensitive members that are arranged in the belt-moving direction; and the endless belt separates from the plurality of photosensitive members simultaneously with one another when the belt unit starts moving from the installation position in the removal direction.

17. An image-forming device as claimed in claim 1, wherein the endless belt conveys a recording medium thereon.

18. An image-forming device as claimed in claim 17, further comprising:

a plurality of process units that are detachably mounted in the housing in one to one correspondence with a plurality of different colors, the at least one photosensitive member including a plurality of photosensitive members mounted in the plurality of process units, respectively;

a supply unit that picks up a recording medium from a cassette and supplies the recording medium to the endless belt when the belt unit is installed in the housing at the installation position; and a discharge unit that receives the recording medium, which has been conveyed by the endless belt and which has been formed with developer images transferred from the photosensitive members, and that discharges the recording medium, the process units are arranged on a path, along which the endless belt conveys the recording medium from the supply unit to the discharge unit, to thereby sequentially forming developer images of the respective colors on the recording medium, a direction, in which the supply unit picks up the recording medium from the cassette, and a direction, in which the discharge unit discharges the recording unit, are substantially opposite to a medium-conveying direction, in which the endless belt conveys the recording medium through image formation positions at which images are formed.

19. An image-forming device as claimed in claim 18, wherein the process units are inserted or removed along a direction that is inclined with respect to both of the medium-conveying direction and a thickness direction of a recording medium that is being conveyed by the endless belt, the thickness direction being orthogonal to the medium-conveying direction.

20. An image-forming device as claimed in claim 18, further comprising a plurality of scanner units in one to one correspondence with the plurality of process units, wherein the process units and the scanner units are disposed alternately in the medium-conveying direction.

21. A belt unit that can be detachably mounted in an image forming device, the belt unit comprising:

a belt unit frame that can be moved along a linear insertion/removal path defined for an image forming device including at least one photosensitive member forming a developer image thereon and that can be installed in the image forming device at an installation position defined on the insertion/removal path, the belt unit frame being capable of being moved toward the installation position in the image forming device along the insertion/removal path in an insertion direction, the belt unit frame being capable of being moved from the installation position along the insertion/removal path in a removal direction that is opposite to the insertion direction;

a plurality of rollers supported by the belt unit frame; and an endless belt supported by the rollers, the endless belt being capable of moving circumferentially around the plurality of rollers, a surface of the endless belt contacting the at least one photosensitive member when the belt unit frame is located in the installation position in the image forming device, the endless belt moving in a belt-moving direction at its contact position where the endless belt contacts each photosensitive drum, the belt-moving direction being angularly shifted from the removal direction to allow the surface of the endless belt to separate from each photosensitive member when the belt unit starts moving in the removal direction from the installation position.

22. A belt unit as claimed in claim 21, further comprising a power supply terminal, the power supply terminal being located at an end portion of the belt unit at a downstream side of the insertion direction of the belt unit, wherein the housing includes an electrode, the power supply terminal being connected to the electrode when the belt unit is installed at the installation position, when the belt unit is moved in the insertion direction toward the installation position in the housing, the endless belt contacting the at least one photosensitive member after the power supply terminal has been connected to the electrode.

23. A belt unit as claimed in claim 21, wherein the at least one photosensitive member includes a plurality of photosensitive members that are arranged in the belt-moving direction, wherein a position of each photosensitive member, with respect to an orthogonal direction that is orthogonal both to the removal direction and to the rotational axial directions of the rollers, is offset by an offset amount from another photosensitive member that is located in an upstream side of the each photosensitive member in the removal direction, and further comprising an urging unit that is supported by the belt unit frame and that causes, when the belt unit is moved from the installation position in the removal direction, contact portions of the endless belt, at which the endless belt contacts the photosensitive members when the belt unit is located at the installation position, to move by a moving amount in the orthogonal direction, the moving amount being smaller than the offset amount.

* * * * *